US008083218B2

(12) United States Patent
Dobashi et al.

(10) Patent No.: US 8,083,218 B2
(45) Date of Patent: Dec. 27, 2011

(54) SHEET FOLDING APPARATUS, IMAGE FORMING APPARATUS USING THE SAME, AND SHEET FOLDING METHOD

(75) Inventors: Shoichi Dobashi, Shizuoka-Ken (JP); Hiroyuki Taguchi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 230 days.

(21) Appl. No.: 12/498,043

(22) Filed: Jul. 6, 2009

(65) Prior Publication Data

US 2010/0009830 A1 Jan. 14, 2010

Related U.S. Application Data

(60) Provisional application No. 61/079,069, filed on Jul. 8, 2008, provisional application No. 61/114,027, filed on Nov. 12, 2008.

(51) Int. Cl.
*B31F 1/10* (2006.01)

(52) U.S. Cl. ..... 270/45; 270/32; 270/58.07; 493/406

(58) Field of Classification Search ..... 270/20.1, 270/32, 37, 58.07; 493/406
See application file for complete search history.

(56) References Cited

U.S. PATENT DOCUMENTS

| | | | | |
|---|---|---|---|---|
| 6,905,118 | B2 | 6/2005 | Yamada et al. | |
| 7,562,866 | B2 * | 7/2009 | Hayashi | 270/58.07 |
| 2006/0281620 | A1 * | 12/2006 | Hayashi et al. | 493/405 |
| 2007/0060459 | A1 * | 3/2007 | Hayashi | 493/434 |
| 2008/0308998 | A1 | 12/2008 | Dobashi et al. | |
| 2009/0036287 | A1 * | 2/2009 | Kawaguchi et al. | 493/442 |

FOREIGN PATENT DOCUMENTS

| | | | |
|---|---|---|---|
| JP | 2002-145516 | A | 5/2002 |
| JP | 2005-89140 | A | 4/2005 |
| JP | 2005-162345 | A | 6/2005 |
| JP | 2006-327765 | A | 12/2006 |

* cited by examiner

*Primary Examiner* — Leslie A Nicholson, III
(74) *Attorney, Agent, or Firm* — Patterson & Sheridan, LLP

(57) ABSTRACT

A sheet folding apparatus includes a fold unit to fold a center of a sheet bundle to form a fold line, a reinforce roller which reciprocates along a direction of the fold line while nipping and pressing the fold line and reinforces the fold line of the sheet bundle, and a control section to changeably set the number of times of reciprocating movement of the reinforce roller according to a thickness of a sheet contained in the sheet bundle.

15 Claims, 23 Drawing Sheets

ROLLER UNIT MOVING
(FOLD LINE REINFORCING OPERATION)

ROLLER UNIT AT HOME POSITION

STANDARD MODE (1/2)

STANDARD MODE (2/2)

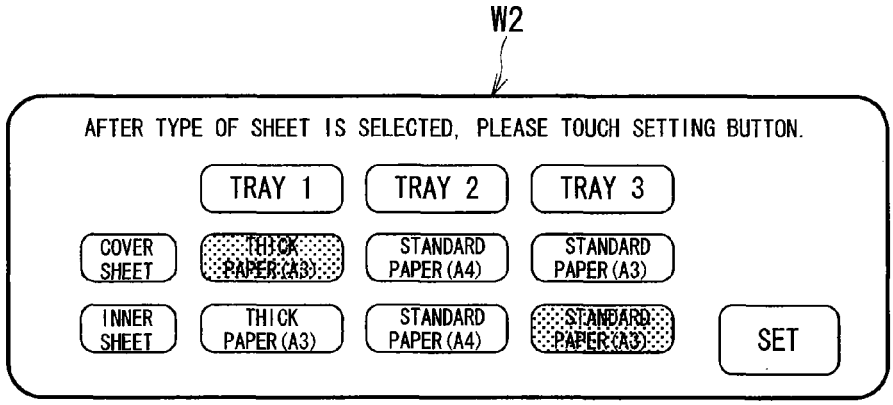
FIG. 20
| LOADING MODE \ SHEET INFORMATION | ALL STANDARD PAPER | ONE THICK PAPER (COVER SHEET) | ALL THICK PAPER |
|---|---|---|---|
| STANDARD MODE | N1 | N2 | N3 |
| UNLIMITED MODE | N4 | N5 | N6 |
N1<N2<N3, N4<N5<N6
N1<N4, N2<N5, N3<N6
FIG. 21A
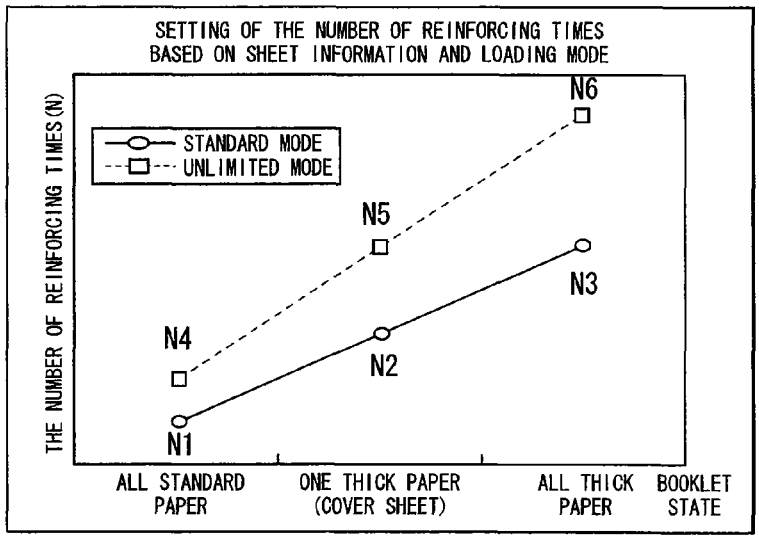
FIG. 21B

SHEET FOLDING APPARATUS, IMAGE FORMING APPARATUS USING THE SAME, AND SHEET FOLDING METHOD

CROSS-REFERENCE TO RELATED APPLICATIONS

This application is based upon and claims the benefit of priority from: U.S. provisional applications 61/079,069 filed on Jul. 8, 2008, and 61/114,027 filed on Nov. 12, 2008, the entire contents of each of which are incorporated herein by reference.

TECHNICAL FIELD

The present invention relates to a sheet folding apparatus, an image forming apparatus using the same, and a sheet folding method, and particularly to a sheet folding apparatus to perform stitching and folding of a printed sheet, an image forming apparatus using the same, and a sheet folding method.

BACKGROUND

Hitherto, there is known a sheet finisher which is placed downstream of an image forming apparatus, such as a copier, a printer or an MFP (Multi-Function Peripheral), and performs finishing, such as punching or stitching, on a printed sheet.

Recently, the function of this sheet finisher is diversified, and a sheet folding apparatus (sheet finisher) is developed which has, in addition to punching and stitching functions, a folding function to fold a part of a sheet, and a saddle-stitching and folding function to staple the center of a sheet and then to fold the sheet at the center (for example, JP-A 2002-145516 etc.).

In the sheet finisher having the saddle-stitching and folding function, it becomes possible also to form a booklet (to bind a book) from a plurality of printed sheets.

In the saddle-stitching and folding proposed hitherto, after the center of sheets is stitched with staples or the like, a process is performed in which a fold line is formed on the stitched part by a pair of rollers called fold rollers and folding is performed. A plate-like member called a fold blade is brought into contact with the stitched part of the sheet bundle, and is pressed into a nip of the fold roller pair to form the fold line on the sheet bundle.

However, the period in which the folded part of the sheet bundle is pressed by the nip of the fold rollers is short, and the whole folded part is simultaneously pressed by the nip of the fold rollers, and accordingly, the pressure is dispersed to the whole fold line. Thus, the fold line formed by the fold rollers becomes the fold line to which the pressure is not sufficiently applied. Particularly, when the number of sheets is large, or when a thick sheet is contained in the sheet bundle, the fold line often becomes incomplete.

In order to deal with this problem, a technique is developed in which a roller called a reinforce roller is additionally provided, and the fold line formed by the fold rollers is reinforced by this reinforce roller.

The reinforce roller is constructed of, for example, a pair of rollers movable along the fold line of the sheet bundle. The fold line of the sheet bundle is nipped by the nip of the reinforce roller, and the reinforce roller is moved along the fold line while pressure is applied to the nip, so that the fold line of the sheet bundle is reinforced.

The reinforce roller usually stands by at a home position slightly spaced from the edge of the sheet bundle, and at the time of execution of reinforcing, the reinforce roller is separated from the home position, and reciprocates along the fold line of the sheet bundle. When the reinforcing is ended, the reinforce roller is again returned to the home position. The number of times of reciprocating movement of the reinforce roller for one sheet bundle (hereinafter sometimes referred to as the number of reinforcing times) is not limited to one, but can be two or more.

When the sheet bundle has a certain degree of thickness, the thickness of the fold line part if the number of reinforcing times is two becomes thinner than the fold line part if the number of reinforcing times is one, and the more excellent fold line can be formed. However, when the fold line becomes thin to a certain degree, even if the number of reinforcing times is further increased, the required time is merely increased, and an obtained effect becomes low.

Besides, in general, when a booklet is formed, the outermost sheet of the sheet bundle becomes the cover sheet of the booklet, and a thick paper thicker than an inner sheet (standard paper) is often used for the cover sheet. For the sheet bundle including the thick paper, when the number of reinforcing times is set to be larger than the number of reinforcing times for the sheet bundle including only the standard paper, it becomes easy to obtain an excellent fold line.

When plural booklets are formed, because of the restriction of the containing size or the like of a tray on which the formed booklets are placed, it is standard to provide the upper limit of the number of formed booklets. A booklet formation mode in which the upper limit of the number of formed booklets is provided is called a "standard mode". On the other hand, when the user desires to continuously form a large number of booklets, a booklet formation mode in which the upper limit of the number of formed booklets is not provided meets the need of the user, and this is called an "unlimited mode". The "standard mode" and the "unlimited mode" can be selectively switched by, for example, a control panel of an apparatus. When the user selects the "unlimited mode", a large number of booklets may be formed. In this case, even if the formation time of one booklet is extended slightly, the formation of a booklet having a thinner fold line than a booklet obtained at the time of selecting the "standard mode" meets the need of the user. That is, it is desirable that the number of reinforcing times in the "unlimited mode" is made larger than the number of reinforcing times in the "standard mode".

As stated above, the suitable number of reinforcing times varies according to the type of a sheet contained in the sheet bundle or the set booklet formation mode. However, if the number of reinforcing times must be changed each time the type of a sheet or the booklet formation condition of the booklet formation mode is changed, the user is urged to perform a complicated operation. Besides, if the number of reinforcing times is set to be unduly large, useless processing time and power consumption are spent. On the other hand, if the number of reinforcing times is set to be unduly small, an excellent fold line can not be obtained.

SUMMARY

An aspect of the disclosure is a sheet folding apparatus including: a fold unit to fold a center of a sheet bundle to form a fold line, a reinforce roller which reciprocates along a direction of the fold line while nipping and pressing the fold line and reinforces the fold line of the sheet bundle, and a control section to changeably set the number of times of reciprocating movement of the reinforce roller according to a thickness of a sheet contained in the sheet bundle.

Besides, another aspect of the disclosure is an image forming apparatus including: a read section to read an original document to generate image data, an image forming section to print the image data to a sheet, a fold unit to bundle printed sheets to form a sheet bundle and to fold a center of the sheet bundle to form a fold line, a reinforce roller which reciprocates along a direction of the fold line while nipping and pressing the fold line and reinforces the fold line of the sheet bundle, and a control section to changeably set the number of times of reciprocating movement of the reinforce roller according to a thickness of a sheet contained in the sheet bundle.

Besides, another aspect of the disclosure is a sheet folding method including: forming a fold line by folding a center of a sheet bundle, reinforcing the fold line of the sheet bundle by reciprocating movement along a direction of the fold line while the fold line is nipped and pressed, and changeably setting the number of times of reciprocating movement of a reinforce roller according to a thickness of a sheet contained in the sheet bundle.

DESCRIPTION OF THE DRAWINGS

In the accompanying drawings:

FIG. 20 is a view showing an example of a display screen for selecting and setting sheet information of sheets constituting a booklet;

FIG. 21A is a view showing an example of a setting table of the number of reinforcing times, FIG. 21B is a view schematically showing an example of the set number of times;

DETAILED DESCRIPTION

Embodiments of a sheet folding apparatus, an image forming apparatus, and a sheet folding method will be described with reference to the accompanying drawings.

(1) Structure of the Image Forming Apparatus and the Sheet Folding Apparatus

Figure 1:
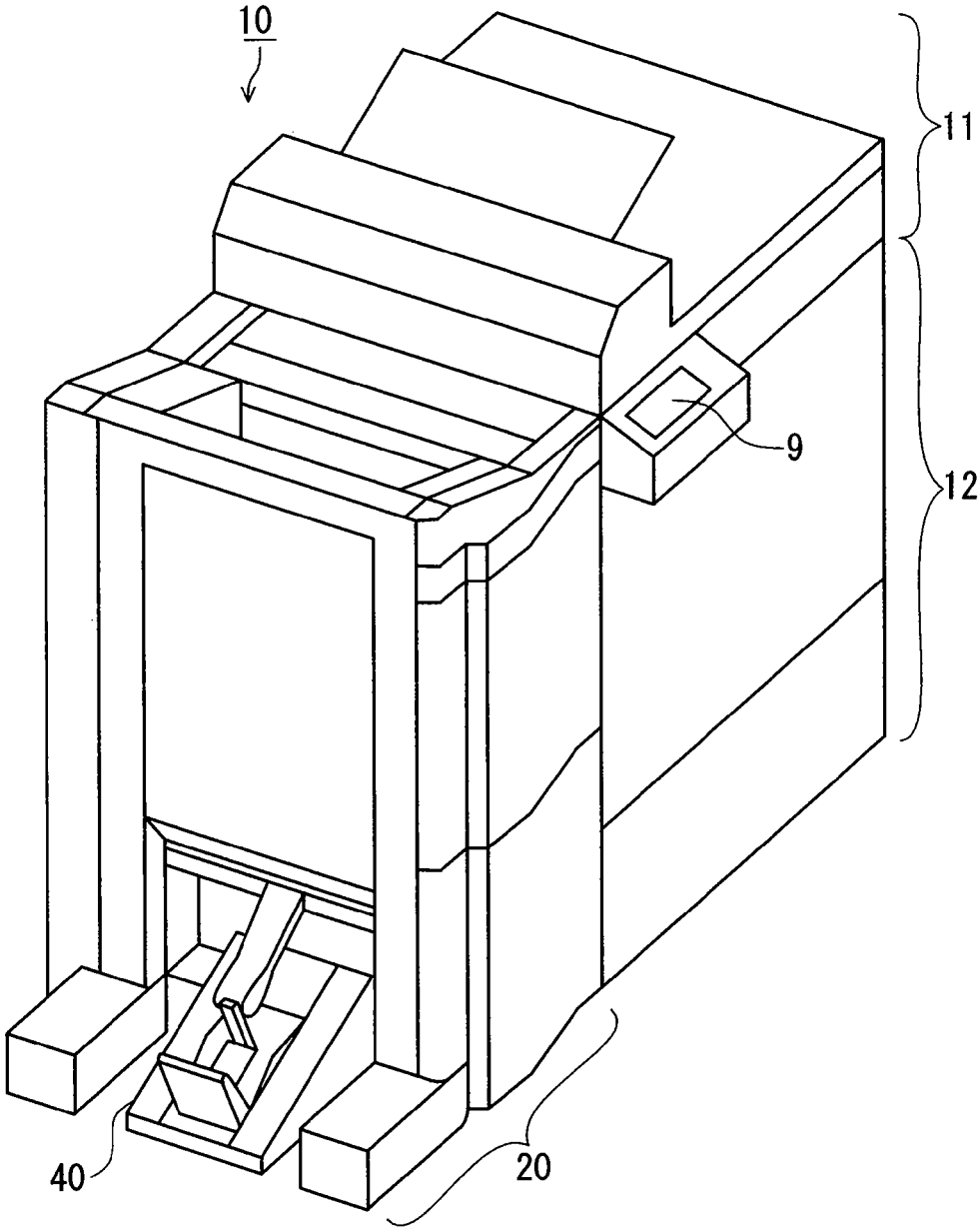
FIG. 1 is a perspective view showing an outer appearance example of an image forming apparatus.

FIG. 1 is an outer appearance perspective view showing a basic structural example of an image forming apparatus 10 of an embodiment. The image forming apparatus 10 includes a read section 11 to read an original document, an image forming section 12 to print the image data of the read original document to a sheet by an electrophotographic system, and a sheet finisher 20 to perform finishing, such as sorting, punching, folding or saddle-stitching, on the printed sheet. Besides, the image forming section 12 is provided with an operation section 9 by which a user performs various operations.

Figure 2:
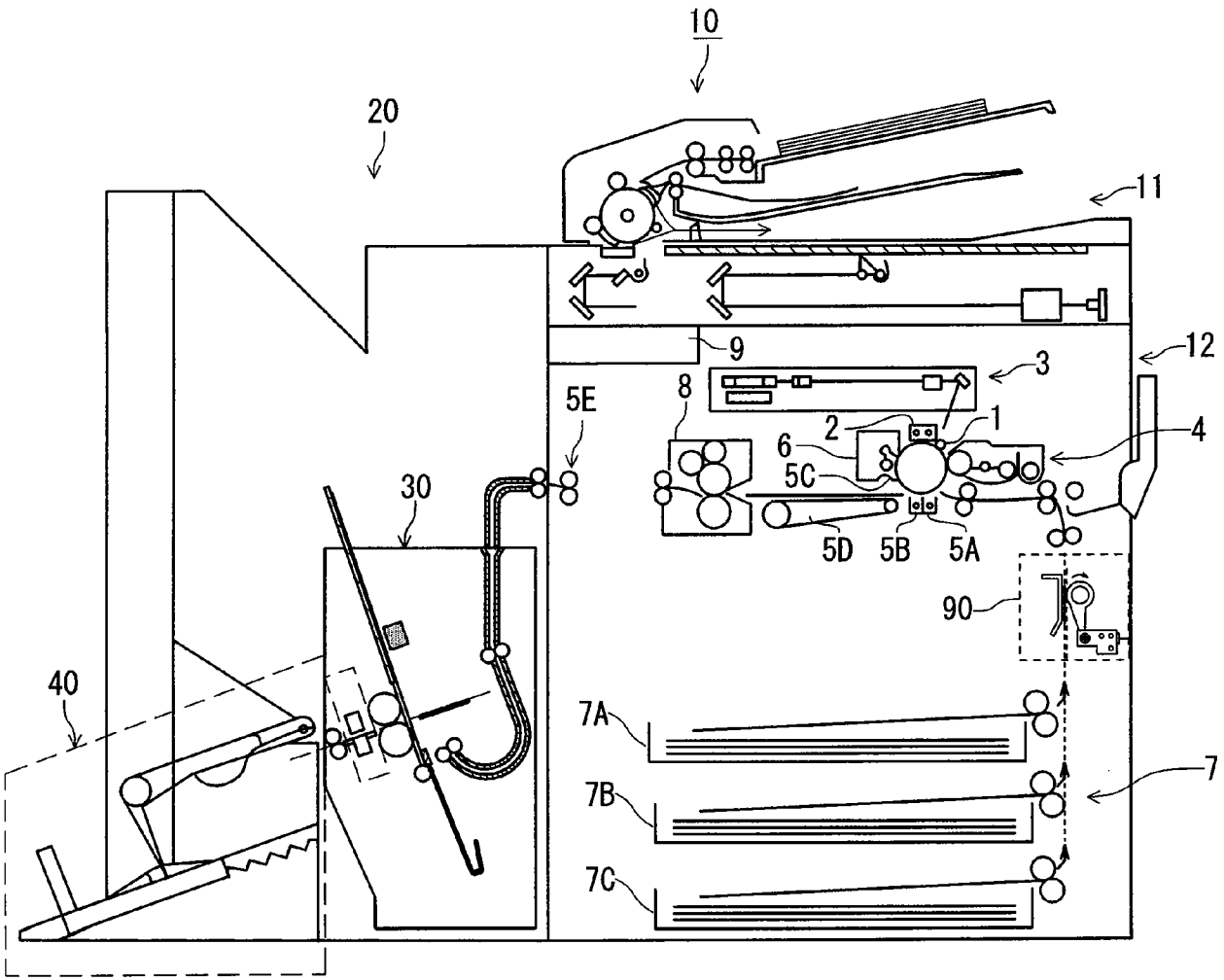
FIG. 2 is a sectional view showing a structural example of the image forming apparatus.

FIG. 2 is a sectional view showing a detailed structural example of the image forming apparatus 10.

The image forming section 12 of the image forming apparatus 10 includes a photoconductive drum 1 at the center thereof, and a charging unit 2, an exposing unit 3, a developing unit 4, a transfer unit 5A, a charge removing unit 5B, a separating pawl 5C and a cleaning unit 6 are respectively disposed around the photoconductive drum 1. Besides, a fixing unit 8 is provided downstream of the charge removing unit 5B. An image forming process is performed by these respective units roughly in the following procedure.

First, the charging unit 2 uniformly charges the surface of the photoconductive drum 1. Meanwhile, an original document read by the read section 11 is converted into image data, and is inputted to the exposing unit 3. The exposing unit 3 irradiates a laser beam corresponding to the level of the image data to the photoconductive drum 1, and forms an electrostatic latent image on the photoconductive drum 1. The electrostatic latent image is developed with toner supplied from the developing unit 4, and a toner image is formed on the photoconductive drum 1.

A sheet contained in a sheet containing section 7 is transported to a transfer position (gap between the photoconductive drum 1 and the transfer unit 5A) through some transport rollers. At the transfer position, the toner image is transferred from the photoconductive drum 1 to the sheet by the transfer unit 5A. The charge removing unit 5B erases the electric charge on the surface of the sheet to which the toner image is transferred. The separating pawl 5C separates the sheet from the photoconductive drum 1. Thereafter, the sheet is transported by an intermediate transport section 5D, and is heated and pressed by the fixing unit 8, so that the toner image is fixed to the sheet. The sheet subjected to the fixing process is ejected from an ejection section 5E and is outputted to the sheet finisher 20.

The cleaning unit 6 disposed downstream of the separating pawl 5C removes a developer remaining on the surface of the photoconductive drum 1, and preparation is made for next image formation.

The sheet finisher 20 includes a sheet folding apparatus 30 and a sheet bundle placing section 40 in addition to a sorter section to sort the sheets.

The sheet folding apparatus 30 performs a process (saddle stitching) in which the center of a plurality of printed sheets ejected from the image forming section 12 is stitched with staples, and then, folding is performed to form a booklet. There is also a case where saddle stitching with staples is not performed, but only folding is performed and a folded sheet bundle is loaded on the sheet bundle placing section 40.

The booklet subjected to the saddle stitching (or folding) by the sheet folding apparatus 30 is outputted to the sheet bundle placing section 40, and the booklet (sheet bundle) is finally placed thereon.

Figure 3:
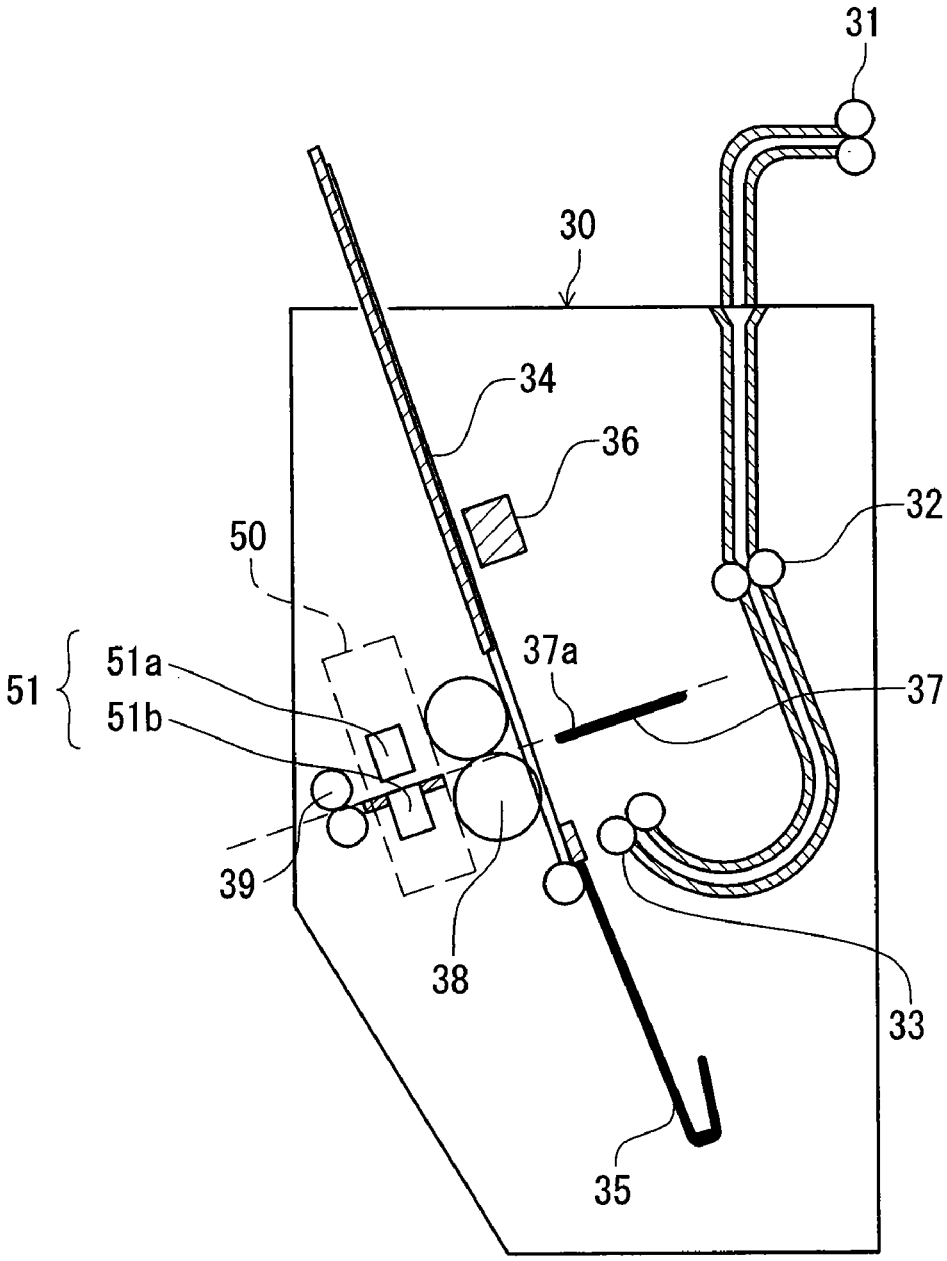
FIG. 3 is a sectional view showing a structural example of a sheet folding apparatus.

FIG. 3 is a sectional view showing a detailed structural example of the sheet folding apparatus 30.

In the sheet folding apparatus 30, the sheet ejected from the ejection section 5E of the image forming section 12 is received by an inlet roller pair 31 and is delivered to an intermediate roller pair 32. The intermediate roller pair 32 further delivers the sheet to an outlet roller pair 33. The outlet roller pair 33 sends the sheet to a standing tray 34 having an inclined placing surface. The leading edge of the sheet is directed to the upper part of the inclination of the standing tray 34.

A stacker 35 is provided below the standing tray 34, and receives the lower edge of the sheet which is switched back and falls from the upper part of the inclination of the standing tray 34.

A stapler (saddle stitch unit) 36 is provided at the middle of the standing tray 34. When the saddle stitching (stapling) is performed on the sheet bundle, the position of the stacker 35 is adjusted so that the position of the sheet bundle to be stapled (the center of the sheet bundle in the up-and-down direction) faces the stapler 36.

After the sheet bundle is stapled by the stapler 36, next, the stacker 35 descends until the position of the sheet bundle where a fold line is to be formed (the center of the sheet bundle in the up-and-down direction and the position where the staples are inserted) comes to the front of a fold blade 37.

When the position where the fold line is to be formed comes to the front of the fold blade 37, a leading edge 37*a* of the fold blade 37 pushes a surface which becomes an inner surface after the sheet bundle is folded.

A fold roller pair 38 is provided ahead of the fold blade 37 in the traveling direction. The sheet bundle pushed by the fold blade 37 is caught in a nip of the fold roller pair 38, and the fold line is formed at the center of the sheet bundle. The fold blade 37 and the fold roller pair 38 constitute a fold unit.

The sheet bundle on which the fold line was formed by the fold roller pair 38 is transported to a fold reinforcing unit 50 provided downstream thereof. The sheet bundle transported to the fold reinforcing unit 50 is temporarily stopped there.

The fold reinforcing unit 50 includes a reinforce roller pair 51 (a pair of rollers including an upper roller 51*a* and a lower roller 51*b*). The reinforce roller pair 51 moves in the direction (direction along the line of the fold line) orthogonal to the transport direction of the sheet bundle while applying pressure to the fold line, and reinforces the fold line.

The sheet bundle whose fold line was reinforced by the fold reinforcing unit 50 again starts to be transported, is pulled by an eject roller pair 39 and is outputted to the sheet bundle placing section 40, and the sheet bundle (booklet) subjected to the saddle stitching is placed on the sheet bundle placing section 40.

(2) Fold Reinforcing Unit

Figure 4:
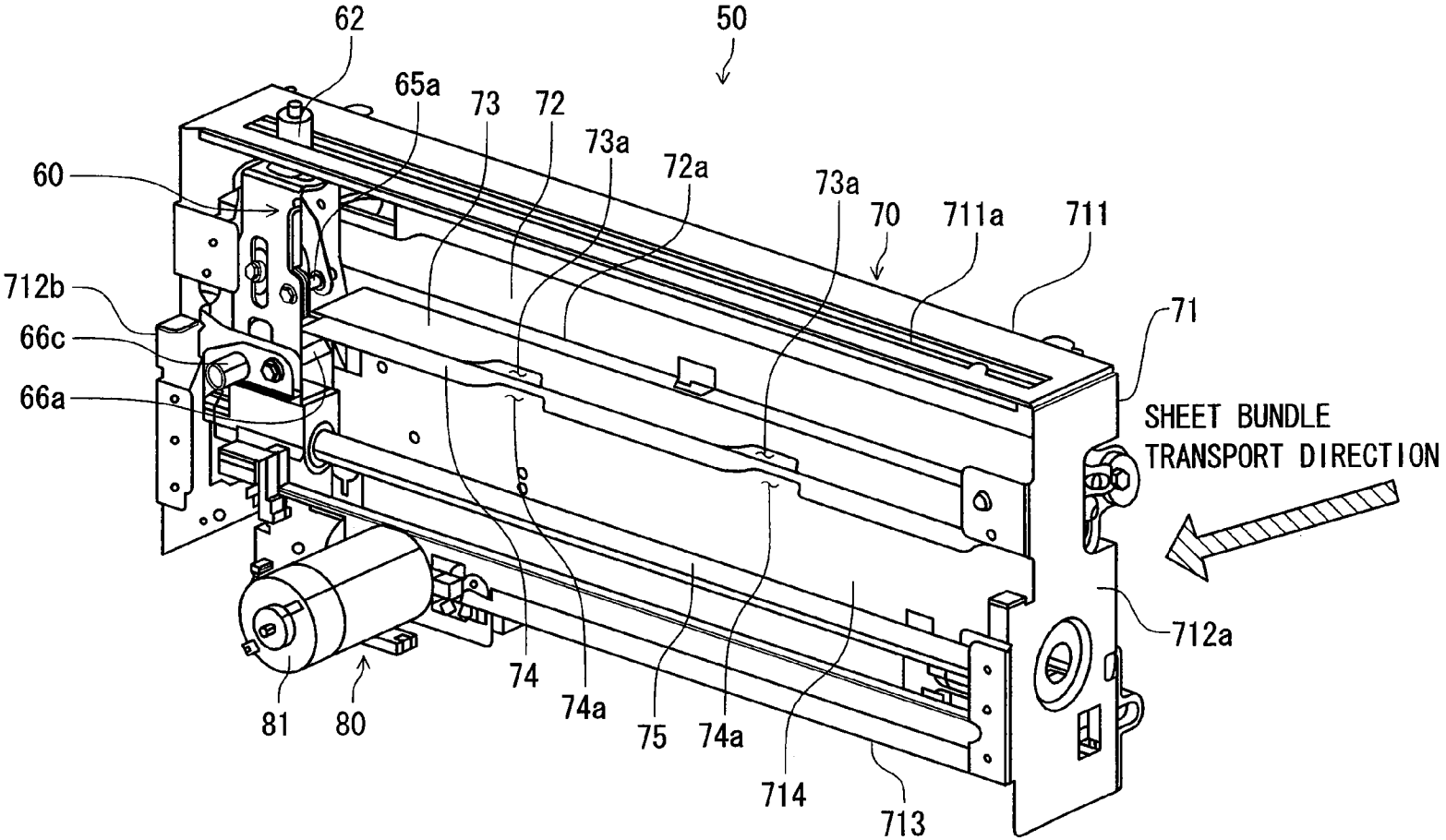
FIG. 4 is a perspective outer appearance view showing the whole structure of a fold reinforcing unit.

FIG. 4 is a perspective outer appearance view showing the whole structure of the fold reinforcing unit 50. The fold reinforcing unit 50 includes a reinforce roller unit 60 (hereinafter simply referred to as a roller unit 60), a support section 70 and a drive section 80.

The roller unit 60 includes the reinforce roller pair 51. The reinforce roller pair 51 nips and pressurizes the fold line of the sheet bundle pushed out from the upstream fold roller pair 38, and moves along the fold line to reinforce the fold line.

The support section 70 supports the roller unit 60 so that the roller unit can slide in the fold line direction, and includes a member of nipping the sheet bundle, a structural member of the whole fold reinforcing unit 50, and the like.

The drive section 80 includes a drive motor 81, and drives the roller unit 60 along the fold line by the drive motor 81.

Figure 5B:
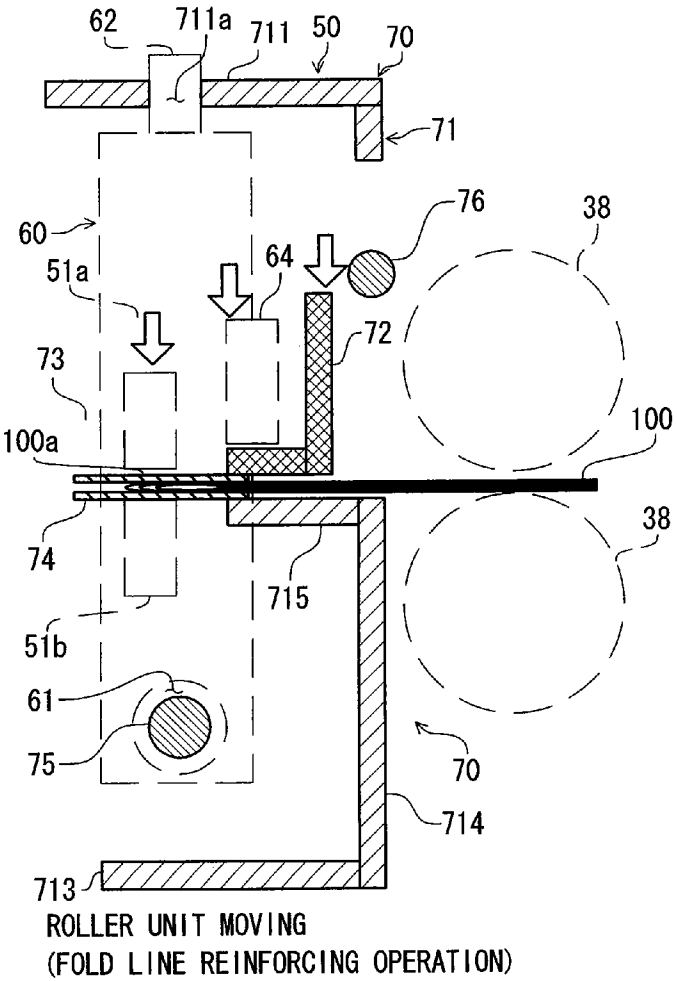
FIGS. 5A and 5B are schematic sectional views for mainly explaining a structure of a support section.
Figure 5A:
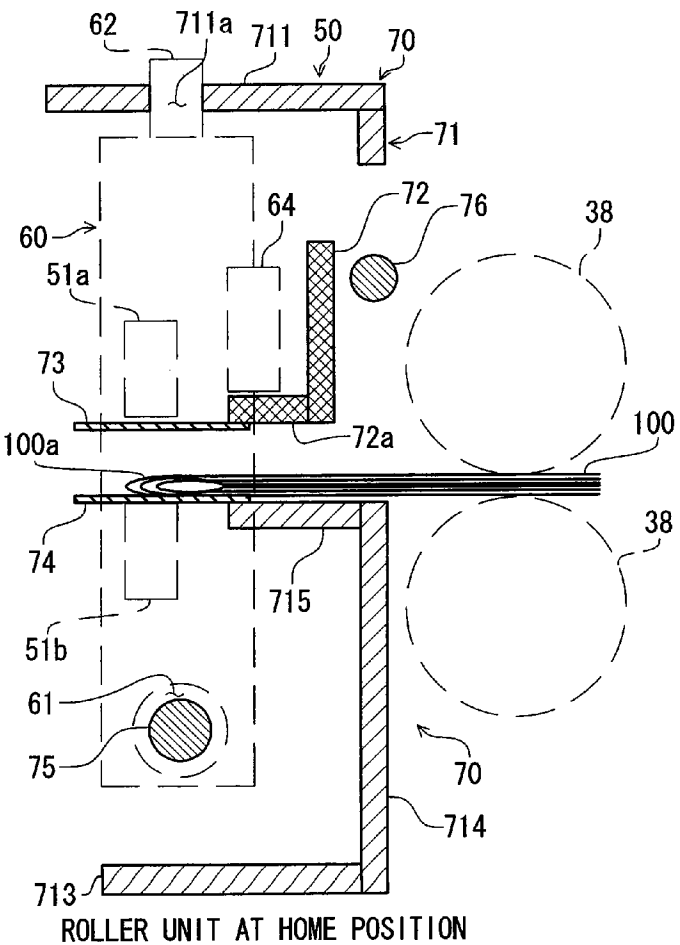

Among the roller unit 60, the support section 70 and the drive section 80, the structure of the support section 70 will be first described by use of FIG. 4 and FIGS. 5A and 5B. FIGS. 5A and 5B are schematic sectional views for mainly explaining the structure of the support section 70. FIG. 5A is a sectional view when the roller unit 60 is at a home position (standby position: left end position in FIG. 4), and FIG. 5B is a sectional view when the roller unit 60 is moving (the fold line is being reinforced).

The support section 70 includes a frame 71, and the frame 71 includes a top plate 711, right and left side plates 712*a* and 712*b*, a bottom plate 713, a back plate 714, a sheet bundle placing table 715 (see FIG. 5A, FIG. 5B, etc.) and the like.

The top plate 711 is provided with a support hole 711*a* extending in the longitudinal direction.

Besides, a support shaft 75 to support the roller unit 60, a transport guide 72 having an L-shaped cross-section, a drive shaft 76 (see FIG. 5A, FIG. 5B, etc.) to drive the transport guide 72 in the up-and-down direction and the like are provided between both the side plates 712*a* and 712*b*.

A band-like flexible member 73 formed of a film-like resin member of polyethylene terephthalate (PET) or the like is extended from a bottom plate 72*a* of the transport guide 72. A similar flexible member 74 is extended also from the sheet placing table 715.

As shown in FIG. 5A and FIG. 5B, a fold line 100*a* of a sheet bundle 100 is nipped between the flexible members 73 and 74, and is pressed by the reinforce roller pair 51 (the upper roller 51*a* and the lower roller 51*b*) through the flexible members 73 and 74, and the fold line is reinforced. The occurrence of a scratch or a wrinkle in the fold line and in the vicinity thereof is prevented through the flexible members 73 and 74.

Cuts 73*a* and 74*b* are provided at the leading ends of the flexible members 73 and 74. These cuts 73*a* and 74*b* are provided at positions corresponding to positions of staples of the fold line, and prevent the flexible members 73 and 74 from being damaged by the staples.

As described later, a through hole 61 through which the support shaft 75 passes is provided in the lower part of the roller unit 60. Besides, a support roller 62 for keeping the attitude is provided in the upper part of the roller unit 60, and the support roller 62 is moved along the support hole 711*a* provided in the top plate 711.

The position (except a position change in the movement direction) of the roller unit 60 and the three-axis attitude are regulated by the support shaft 75, the through hole 61, the support hole 711*a* and the support roller 62, and are kept constant also during the movement of the roller unit 60.

Figure 6:
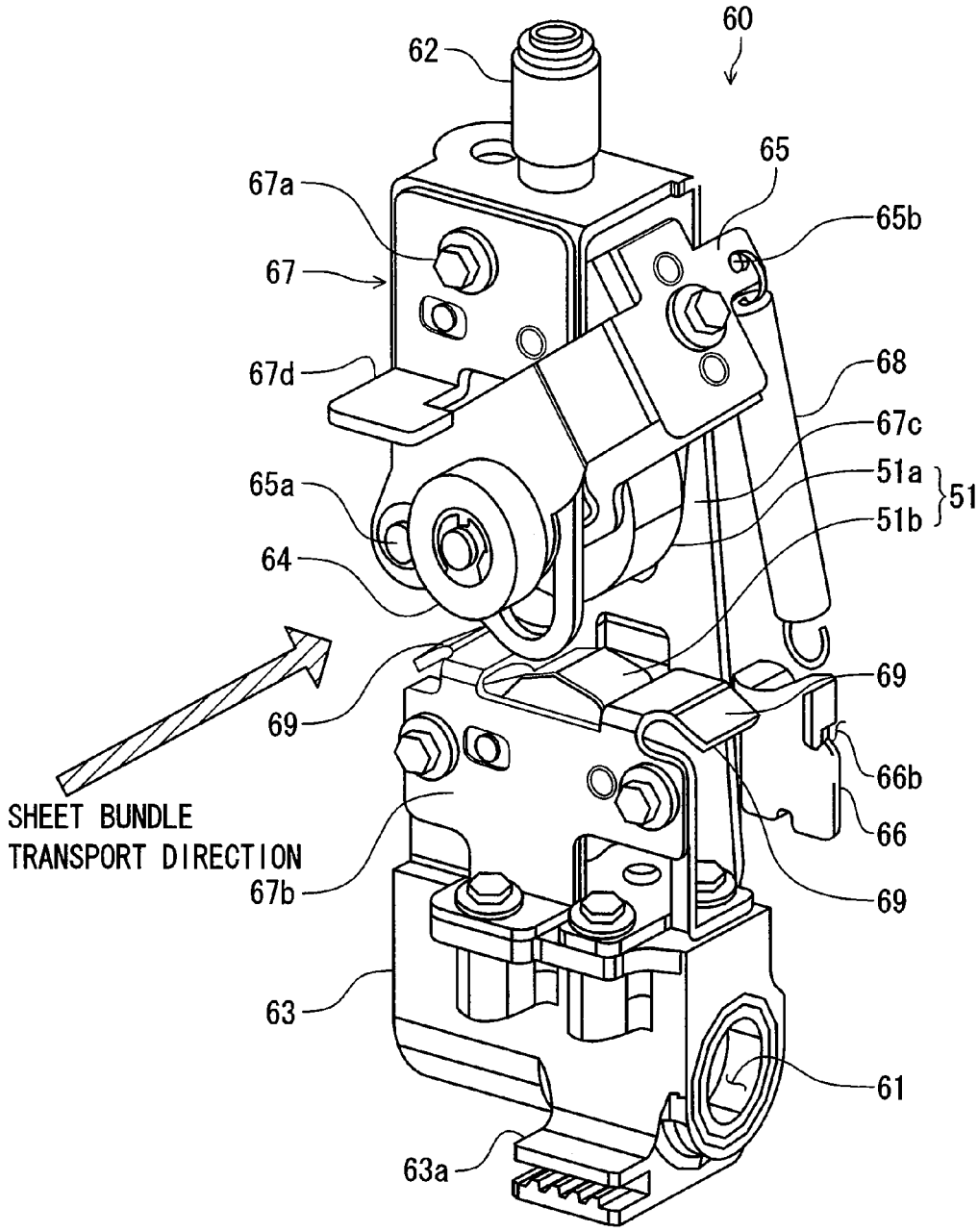
FIG. 6 is a perspective outer appearance view showing a structural example of a roller unit.

Next, the structure of the roller unit 60 will be described. FIG. 6 is a perspective outer appearance view showing a structural example of the roller unit 60, and is a view seen from the sheet bundle sending source direction (direction opposite to FIG. 4).

The roller unit 60 builds in the reinforce roller pair 51, and includes a unit support section 63 that is positioned at the lower part and is provided with the through hole 61, and a unit frame 67 fixed to the upper part of the unit support section 63.

In the unit frame 67, an upper frame 67*a* having a hollow part and a lower frame 67*b* having a hollow part are fixed and coupled by a frame plate 67*c*.

Besides, the roller unit 60 includes an upper link member 65 and a lower link member 66, and both are spring coupled by a spring 68. One end of the spring 68 is engaged with a hook hole 65*b* of the upper link member 65, and the other end of the spring 68 is engaged with a cut part 66*b* of the lower link member 66. Although FIG. 6 shows the spring 68 in a free state in which the other end of the spring 68 is released from the cut part 66*b*, in the state where the other end of the spring 68 is actually engaged with the cut part 66*b*, the pulling force of the spring 68 is applied between the upper link member 65 and the lower link member 66.

The lower roller 51*b* as one of the reinforce roller pair 51 is contained in the hollow part of the lower frame 67*b*. The lower roller 51*b* is freely rotatably supported around a lower roller shaft (not shown) fixed to the lower frame 67*b*.

The lower link member 66 is rotatably coupled to the side of the lower frame 67*b* through a lower link shaft 66*a* (see FIG. 4) fixed to the lower frame 67*b*.

The upper roller 51*a* as the other of the reinforce roller pair 51 is contained in the hollow part of the upper frame 67*a*. The upper roller 51*a* is freely rotatably supported around an upper roller shaft (not shown) fixed to the upper link member 65 (not the upper frame 67*a*).

The rotation shaft (lower roller shaft) of the lower roller 51*b* is fixed to the lower frame 67*b* (that is, fixed to the unit frame 67), and even if the roller unit 60 is moved, the position of the lower roller 51*b* is not changed in the up-and-down direction. An adjustment is made so that the position of the upper end of the lower roller 51*b* becomes the same as the position of the flexible member 74, and when the roller unit 60 is moved, the lower roller 51*b* comes in contact with the lower surface of the flexible member 74 and is rotated.

On the other hand, the upper roller shaft of the roller 51*a* is fixed to the upper link member 65. When the roller unit 60 is separated from the home position and starts to move, the upper link member 65 is pulled by the spring 68, and starts to rotate downward around the upper link shaft 65*a*. By this rotation, the upper roller 51*a* rotatably attached to the upper link member 65 starts to descend, and is moved to a position where it comes in contact with the lower roller 51*b*. The press force caused by the pulling force of the spring 68 is mutually exerted between the upper roller 51*a* and the lower roller 51*b*. Actually, since the sheet bundle is nipped between the upper roller 51*a* and the lower roller 51*b* through the flexible members 73 and 74, the fold line of the sheet bundle is reinforced by the press force between the upper roller 51*a* and the lower roller 51*b*.

Figure 7:
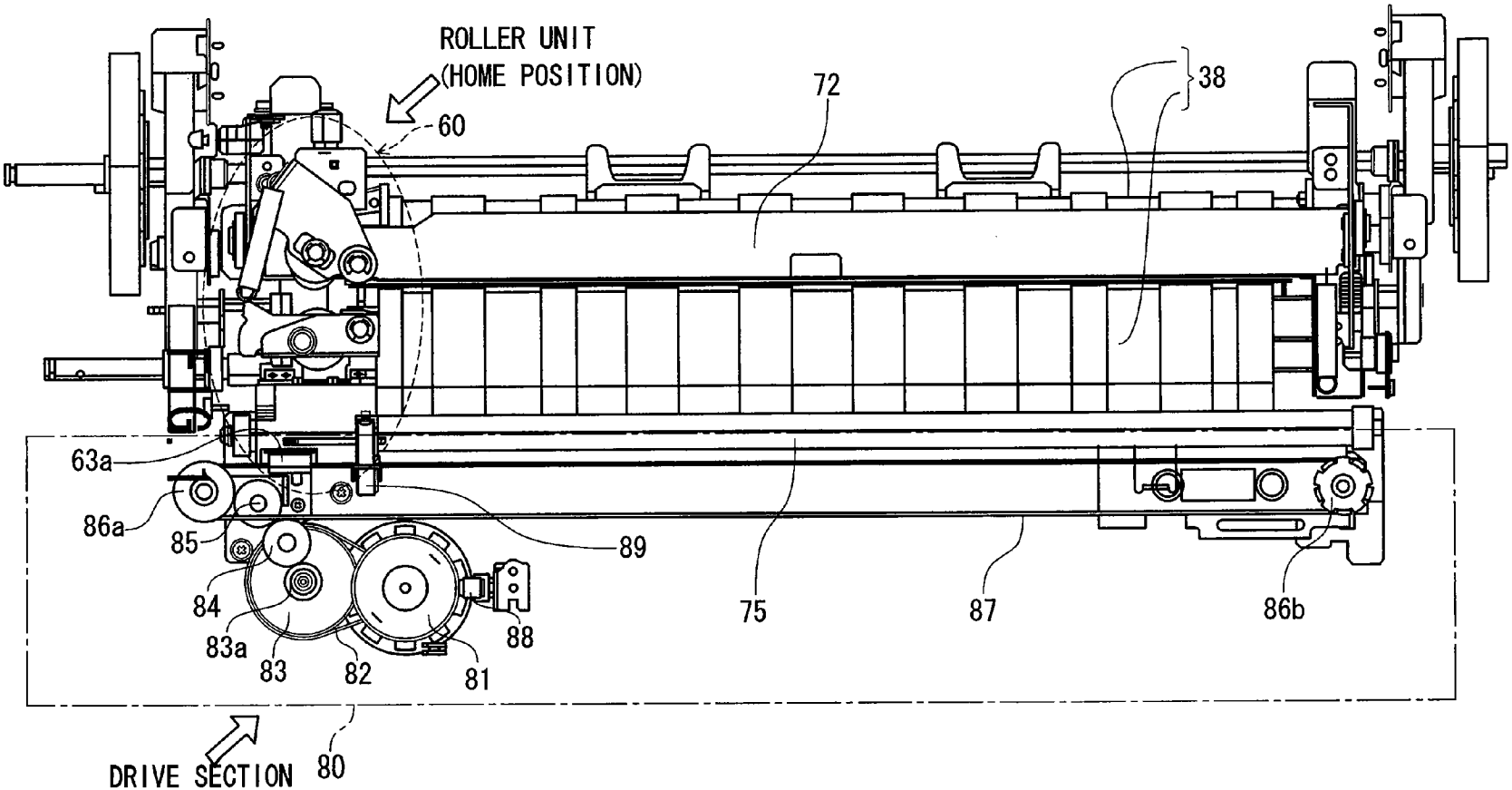
FIG. 7 is a view of the fold reinforcing unit seen from the transport destination of a sheet bundle.

Next, a structure of the drive section 80 will be described. FIG. 7 is a view showing a structure and a structural example of the drive section 80. FIG. 7 is a view seen in the direction from a transport destination of a sheet bundle to a transport source, and also shows the roller unit 60 at the home position, the fold roller pair 38 and the drive mechanism of the fold roller pair 38. The illustration of the structural member of the support section 70 is partially omitted for convenience of explanation.

The drive unit 80 includes a drive motor 81 which is only one drive source of the fold reinforcing unit 50. The drive motor 81 is a DC motor, and the rotation direction and rotation speed can be controlled from outside.

The drive force of the drive motor 81 is transmitted to a pulley 83 through a motor belt 82, and is further transmitted from a gear 83*a* of the pulley 83 to a drive side pulley 86*a* through a gear 84 and a gear 85. On the other hand, a unit drive belt 87 is stretched between the drive side pulley 86*a* and a driven side pulley 86*b*. The unit drive belt 87 is moved between the drive side pulley 86*a* and the driven side pulley 86*b* by the drive force of the drive motor 81.

A rack is formed on the surface of the unit drive belt 87, and the rack is engaged with teeth of a fit section 63*a* (see FIG. 6) provided at the lower part of the roller unit 60, so that the roller unit 60 can be certainly moved in the fold line direction without sliding. The movement direction of the unit drive belt 87 can be changed by reversing the rotation direction of the drive motor 81, and the roller unit 60 can be reciprocated.

The movement amount and movement speed of the unit drive belt 87, that is, the movement amount and movement speed of the roller unit 60 can be controlled by rotation control of the drive motor 81. The rotation amount and rotation speed of the drive motor 81 is detected by a train of pulse signals outputted from an encoder sensor 88 disposed near the drive motor 81, and the rotation control of the drive motor 81 is performed based on the detected rotation amount and rotation speed.

The drive motor 81 may be constructed of a pulse motor. In this case, the rotation speed can be detected by counting the pulses directly outputted from the drive motor 81.

Figure 8:
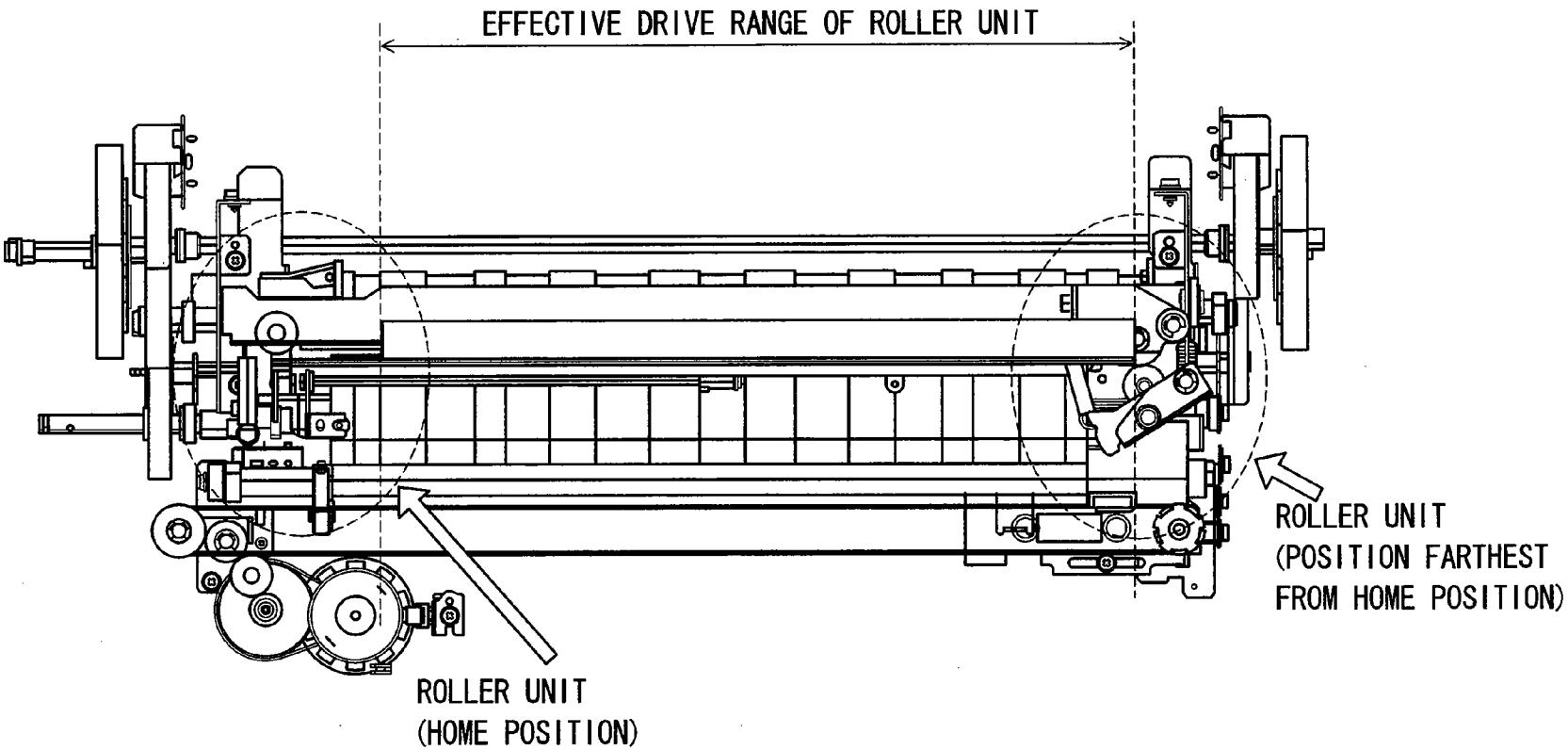
FIG. 8 is a view for explaining an effective drive range of the roller unit.

FIG. 8 is a view showing a relation between the effective drive range of the roller unit 60 and the width of a processable maximum sheet size (for example, A3 size). As-shown in FIG. 8, the home position of the roller unit 60 is set at a position where even the sheet bundle of the processable maximum size does not interfere. On the other hand, the position farthest from the home position of the roller unit 60 is set at the farthest position within the range where the nip of the reinforce roller pair 51 does not pass through the end of the sheet bundle of the processable maximum size.

The roller unit 60 starts movement to separate from the home position, moves along the fold line while reinforcing the fold line, and is once stopped at the end of the sheet bundle at the opposite side to the home position. Thereafter, the roller unit moves on the return path while continuously reinforcing the fold line, and is returned to the home position.

The position where the roller unit is once stopped at the edge of the sheet bundle at the opposite side to the home position varies according to the sheet size, and the once stopped position is determined based on the information of the sheet size.

In the fold reinforcing unit 50, the up-and-down drive of the upper roller 51*a* in the inside of the roller unit 60 and the up-and-down drive of the transport guide 72 are also performed in addition to the movement of the roller unit 60 in the fold line direction, and the drive source of all these up-and-down drives is the drive motor 81. That is, all the drive operations of the fold reinforcing unit 50 are performed by the single drive motor 81. Hereinafter, the mechanism of the up-and-down drive of the upper roller 51*a* will be described.

Figure 9:
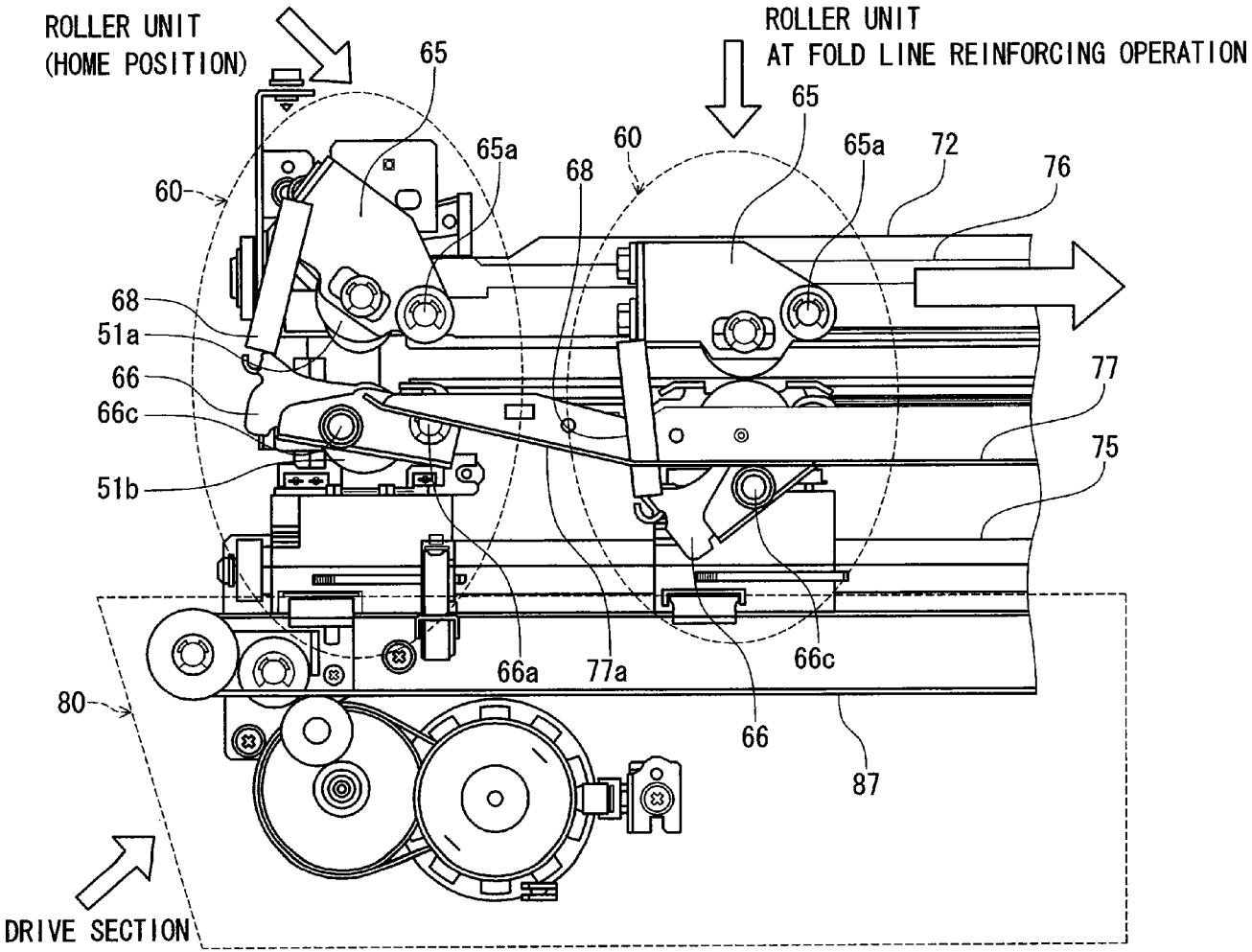
FIG. 9 is a first view for explaining the mechanism of up-and-down driving of an upper roller.
Figure 10:
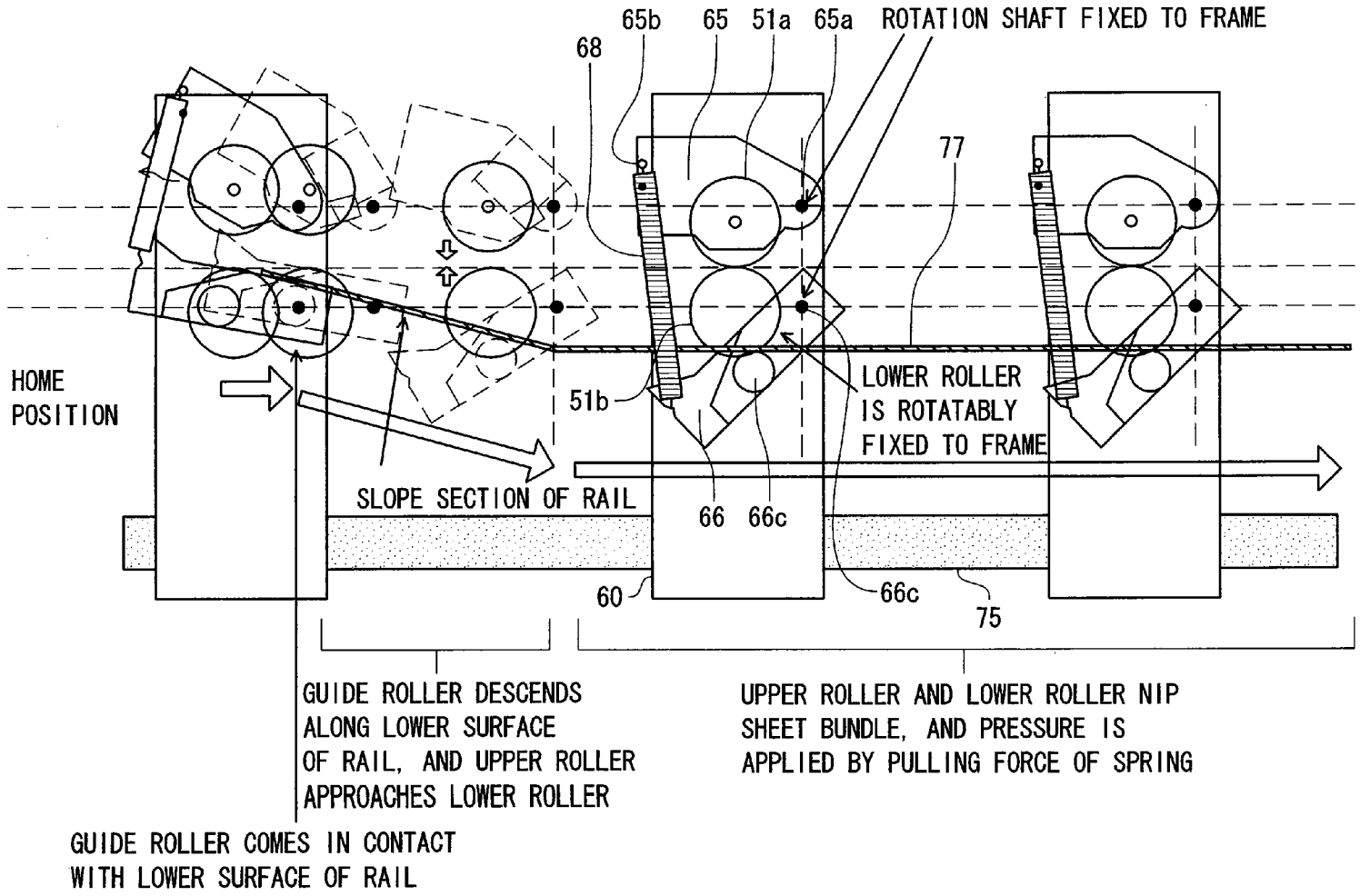
FIG. 10 is a second view for explaining the mechanism of up-and-down driving of the upper roller.

FIG. 9 and FIG. 10 are views for explaining the mechanism of the up-and-down drive of the upper roller 51*a*. As described before, the upper link member 65 and the lower link member 66 of the roller unit 60 are spring coupled by the spring 68 at the positions farthest from the respective rotation shafts (65*a*, 66*a*). Besides, the lower link member 66 is provided with a freely rotating guide roller 66*c* (see FIG. 4, etc.).

On the other hand, as shown in FIG. 9, the support section 70 includes a guide rail 77 having an L-shaped cross-section. The guide rail 77 has an inclined section 77*a* inclined in the vicinity of the home position, and is parallel to the fold line direction of the sheet bundle except for the inclined section 77*a*.

When the roller unit 60 is driven by the drive belt 87 and is separated from the home position, as shown in FIG. 10, the guide roller 66*c* comes in contact with the bottom of the inclined section 77*a* of the guide rail 77 before long. Thereafter, the guide roller 66*c* descends along the bottom of the inclined section 77*a*. As the guide roller 66*c* descends, the lower link member 66 is rotated around the lower link shaft 66*a* in the counterclockwise direction in FIG. 10. Besides, the upper link member 65 is also pulled by the spring 68 and is rotated around the upper link shaft 65*b* in the counterclockwise direction. As a result, the upper roller 51*a* between the upper link shaft 65*b* and the hook hole 65*b* of the spring 68 gradually descends while the roller unit 60 moves on the inclined section 77*a*, and the interval between the upper roller 51*a* and the lower roller 51*b* is gradually shortened. Then, the upper roller 51*a* and the lower roller 51*b* come in contact with each other in the vicinity of an area where the inclined section 77*a* is terminated. At this time, a pressure (pressing force) to press each other is exerted between the upper roller 51*a* and the lower roller 51*b*. The pressing force is based on the pulling force of the spring 68.

In a horizontal area (that is, the effective drive area) of the guide rail 77, the upper roller 51*a* and the lower roller 51*b* apply the pressure to the fold line of the sheet bundle and reinforce the fold line while keeping the pressing force.

(3) Drive Control of Reinforce Roller (Roller Unit)

Next, drive control of the sheet bundle in the transport direction and drive control of the roller unit 60 in the fold line direction (direction orthogonal to the transport direction of the sheet bundle) will be described.

The driving of the sheet bundle in the transport direction is performed by a fold roller motor (not shown) to rotate the fold roller pair 38. The rotation start, stop and rotation amount of the fold roller motor are controlled, so that the timing of movement start and movement stop of the sheet bundle in the transport direction, the movement amount and the like are controlled.

Figure 11:
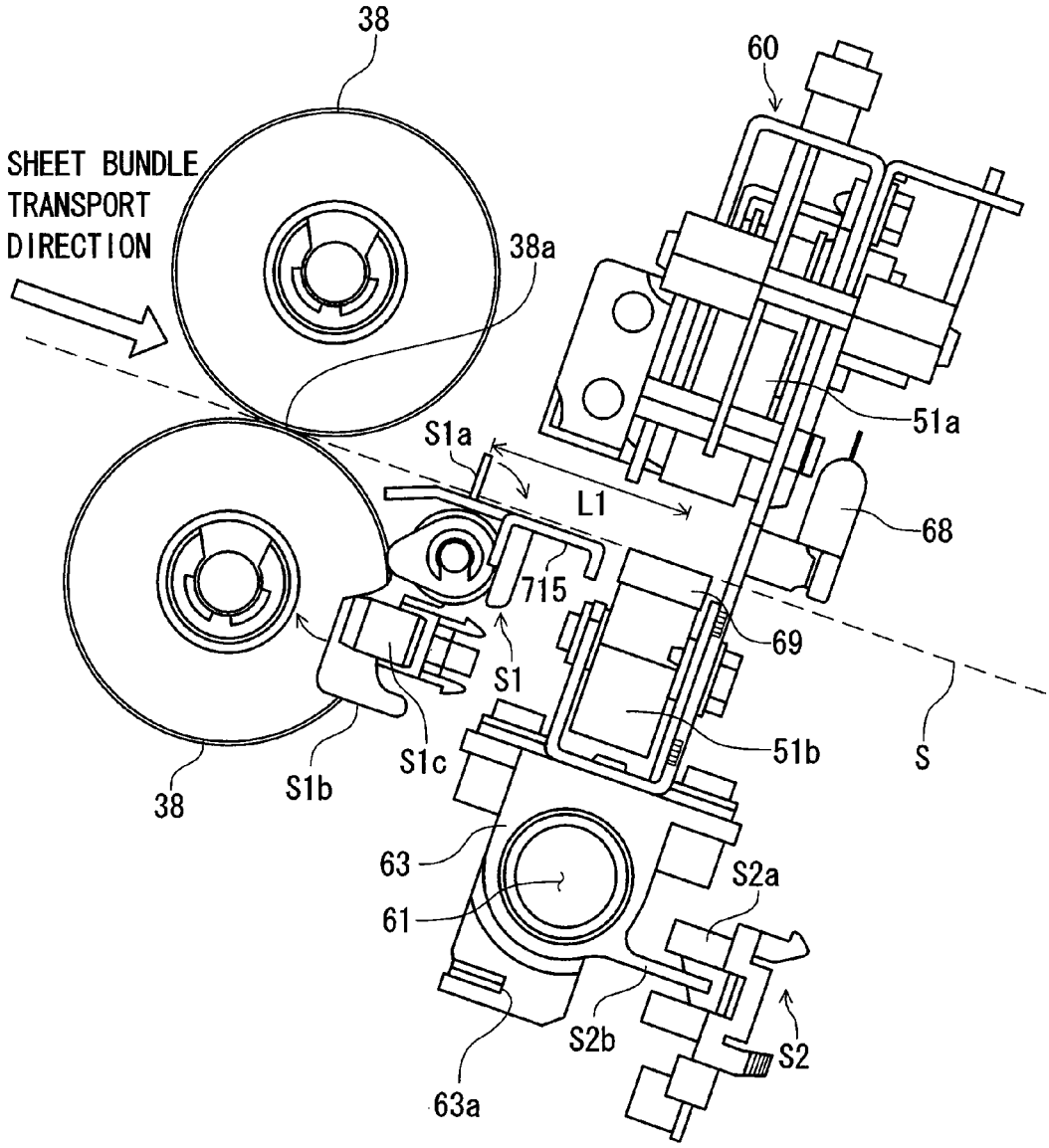
FIG. 11 is a view showing a relation between respective positions of a transport reference surface of a sheet bundle, a nip of a fold roller pair and an upper end of a lower roller.

In the drive control of the sheet bundle in the transport direction, the on and off information of an eject transport sensor S1 is used. As shown in FIG. 11, the eject transport sensor S1 includes, for example, a lever S1*a* provided on a transport reference surface S, a light-shielding plate S1*b* and a photosensor S1*c*.

In a state where there is no sheet bundle on the sheet bundle placing table 715, the lever S1*s* stands upright, and the light-shielding plate S1*b* coupled to the lever S1*a* shields a light path in the photosensor S1*c*. This state is a state in which the eject transport sensor S1 is off. When the leading edge of the sheet bundle passes through the lever S1*a*, the lever S1*a* falls in the transport direction, and in connection with this, the light-shielding plate S1*b* disappears from the light path in the photosensor S1*c*. This state is a state in which the eject transport sensor S1 is on. When the fold line reinforcing of the sheet bundle is ended, the sheet bundle is further moved in the transport direction, and when the trailing edge of the sheet bundle passes through the position of the lever S1*a*, the lever S1*a* returns to the upright state, and the eject transport sensor S1 is again put in the off state.

On the other hand, with respect to the driving of the roller unit 60 in the fold line direction, the start, stop and rotation amount of the rotation of the drive motor 81 are controlled, so that the timing of movement start and movement stop of the roller unit 60, the movement amount, the movement speed and the like are controlled.

The on and off information of a home position sensor S2 is used for the drive control of the roller unit 60. For example, as shown in FIG. 11, the home position sensor S2 includes a photosensor S2*a* set at the position of the home position, and a light-shielding plate S2*b* provided at the lower part of the roller unit 60.

When the roller unit 60 is at the position of the home position, the light-shielding plate S2*b* shields the light path of the photosensor S2*a*. This state is a state where the home position sensor S2 is on. When the roller unit 60 is separated from the home position, since the light-shielding plate S2*b* is also moved together with the roller unit 60, the light path of the photosensor S2*a* is opened. This state is a state where the home position sensor S2 is off.

Figure 12:
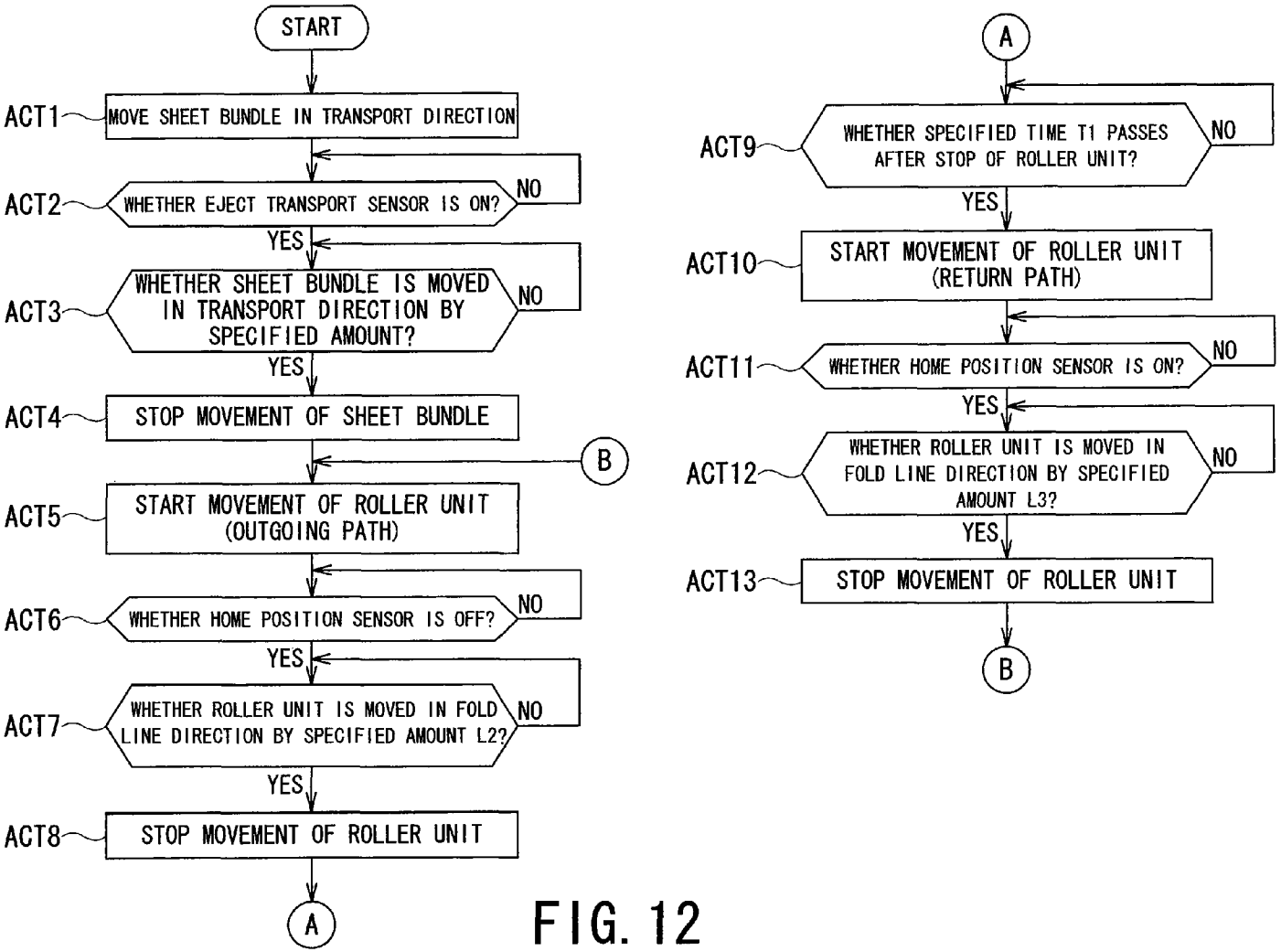
FIG. 12 is a flowchart showing an example of a drive control of the sheet bundle in a transport direction and a drive control process of the roller unit in a fold line direction.

FIG. 12 is a flowchart showing an example of the process of the drive control of the sheet bundle in the transport direction and the drive control of the roller unit 60 in the fold line direction.

Figure 13:
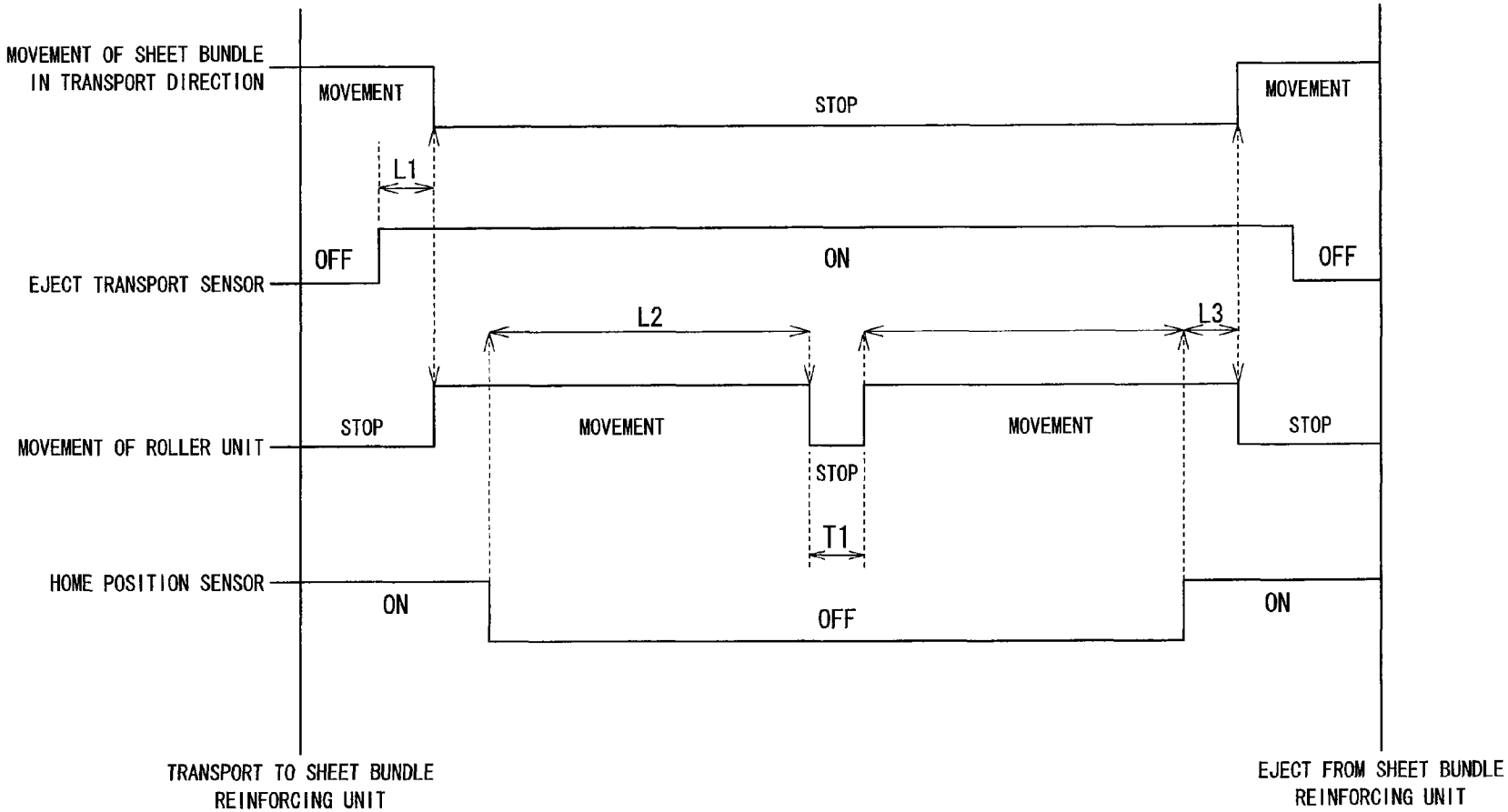
FIG. 13 is a timing chart showing a temporal relation between a movement and stop state of the sheet bundle in the transport direction, an on and off state of an eject transport sensor, a movement and stop state of the roller unit in the fold line direction, and an on and off state of a home position sensor.

FIG. 13 is a timing chart showing a temporal relation between the movement and stop state of the sheet bundle in the transport direction, the on and off state of the eject transport sensor S1, the movement and stop state of the roller unit 60 in the fold line direction, and the on and off state of the home position sensor S2.

At ACT 1 of FIG. 12, the sheet bundle is moved in the transport direction and is transported to the fold reinforcing unit 50. Next, it is determined whether the leading edge of the sheet bundle reaches the position of the eject transport sensor S1 (ACT 2). This determination is made based on the change of the eject transport sensor S1 from off to on. Further, it is determined whether the leading edge of the sheet bundle is moved from the position of the eject transport sensor S1 by a specified amount L1 (ACT 3). This determination is made based on the number of pulses of an encoder (not shown) of the fold roller motor.

When the leading edge of the sheet bundle, that is, the fold line is transported from the position of the eject transport sensor S1 by the specified amount L1, the movement of the sheet bundle in the transport direction is stopped (ACT 4). At the same time, the movement (outgoing path) of the roller unit 60 from the home position is started (ACT 5).

A state of the home position sensor S2 changes from on to off on detecting that the roller unit 60 displaces from the home position (ACT 6).

The roller unit 60 further continues moving, and is stopped at a place (opposite side to the home position) which the roller unit reaches after movement of a specified amount L2 from the position where the home position sensor S2 is turned off (ACT 7, ACT 8). Incidentally, the movement amount L2 is obtained based on the number of pulses of the encoder of the drive motor 81.

When the roller unit 60 is stopped at the opposite side to the home position, the stop time is counted by an appropriate counter, and when the stop time reaches a specified time T1

(ACT 9), the roller unit 60 starts the movement in the opposite direction (return path) (ACT 10).

When the roller unit 60 approaches the home position, and passes through the position of the home position sensor S2, the home position sensor S2 is changed from off to on (YES at ACT 11). Thereafter, when movement of a specified amount L3 is performed (YES at ACT 12), the movement of the roller unit 60 is stopped (ACT 13).

The procedure of from ACT 1 to ACT 13 is the flow of the reinforcing (first). When the roller unit 60 is reciprocated plural times for one sheet bundle to perform the reinforcing, the process of from ACT 5 to ACT 13 is repeated for the second reinforcing or later.

(4) Setting of the Number of Reinforcing Times

First Embodiment

The image forming apparatus 10 of this embodiment is constructed such that the number of reinforcing times can be automatically changed and set according to the type of a sheet constituting a sheet bundle and the loading mode of the sheet placing section 40. Hereinafter, a process of a case where the number of reinforcing times is two or more will be described.

Figure 14:
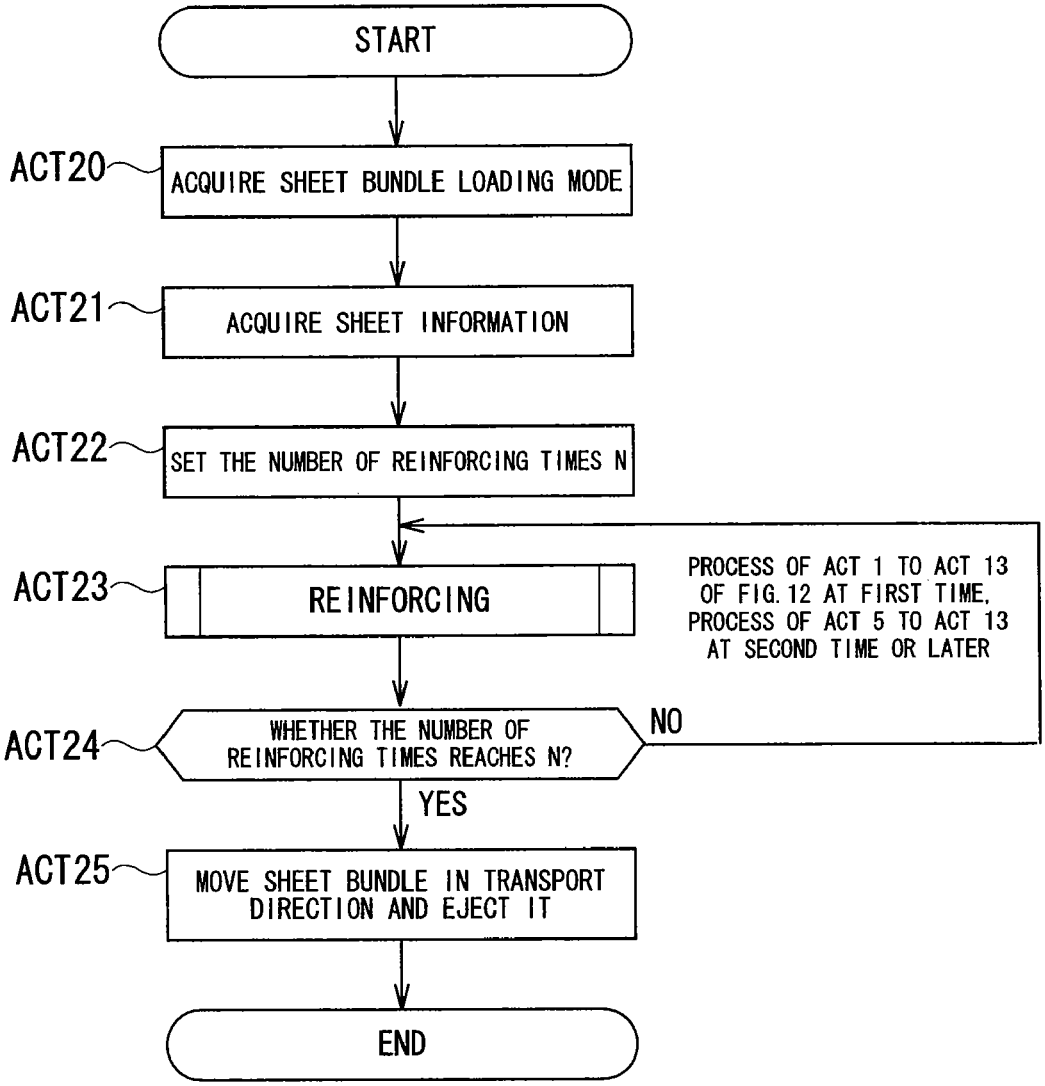
FIG. 14 is a flowchart showing a processing example of a case where reinforcing is performed plural times.

FIG. 14 is a flowchart showing a process example of a case where reinforcing is performed plural times in the sheet finisher 20.

At ACT 20, the sheet finisher 20 acquires information relating to the loading mode of a sheet bundle from an image forming apparatus main body (structure obtained by removing the sheet finisher 20 from the image forming apparatus 10), and acquires sheet information at ACT 21.

Here, the loading mode of the sheet bundle will be described. The loading mode includes, for example, a "standard mode" in which the loading number of sheet bundles loaded on the sheet placing section 40 (loading tray) is limited, and an "unlimited mode" in which the loading number is not limited. First, the "standard mode" will be described.

Figure 15A:
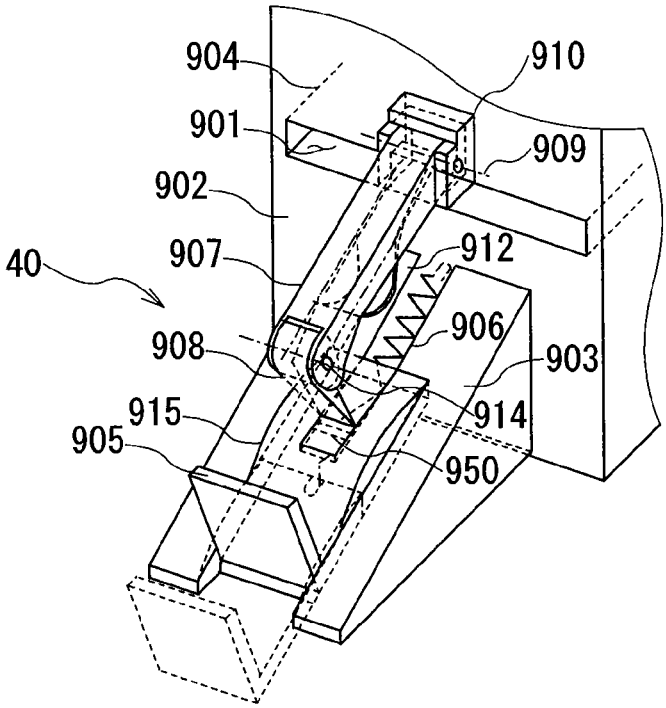
FIG. 15A and FIG. 15B are views showing an outer appearance example of a sheet placing section and a structural example thereof.

FIG. 15A is an enlarged view showing the sheet placing section 40 of the sheet finisher 20.

The sheet placing section 40 includes abed 903, abase plate 915, an upper arm 907, and a fore arm 908. An attachable and detachable guard 905 is provided at a front end of the base plate 915.

The base plate 915 is connected to an outer wall 902 of the image forming apparatus main body through a spring 906, and can slide along the inclination of the bed 903.

A root of the upper arm 907 is rotatably supported around a shaft 909 provided in a support 910 fixed to the outer wall 902.

A shaft 941 is provided at a front end of the upper arm 907, and the fore arm 908 is rotatably supported by the shaft 914.

The base plate 915 has a gentle hill at the center in a direction along the inclination, and a flapper 950 is provided in the vicinity of an apex of the hill. Besides, a recess is formed in a part of the inclination upper the flapper 950.

Figure 15B:
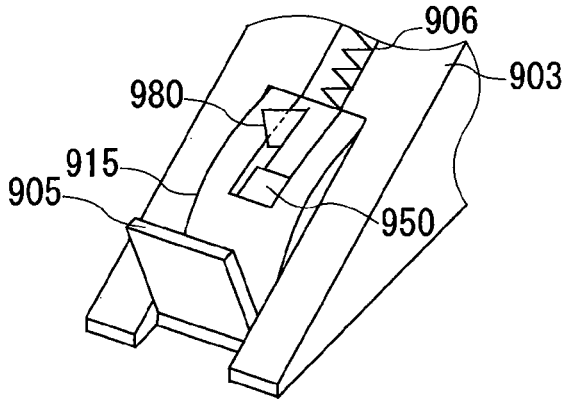

FIG. 15B is a view showing a state where the upper arm 907 and the fore arm 908 are removed from the sheet placing section 40. A sheet sensor (not shown) for detecting a sheet bundle is contained in the inside of the bed 903, and the sheet sensor includes a detection lever 980. In a state where the sheet bundle is not placed on the base plate 915, as shown in FIG. 15B, the detection lever 980 protrudes from the recess of the base plate 915 and is exposed. When even a part of the sheet bundle is placed on the base plate 915, the detection lever 980 is sunk by the weight of the sheet bundle. By this movement of the detection lever 980, the sheet sensor can distinguish between a state (non-loading state) in which no sheet bundle is loaded on the base plate 915 and a state (loading state) in which at least a part of the sheet bundle is loaded.

Figure 16A:
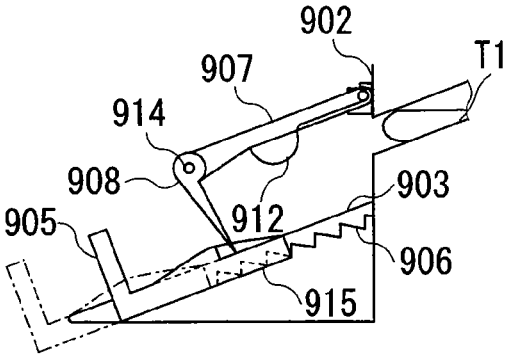
FIGS. 16A to 16C and FIGS. 17A to 17C are views for explaining a sheet bundle loading state to a sheet placing section in a standard mode.

FIGS. 16A to 16C and FIGS. 17A to 17C are views showing loading states in the "standard mode". FIG. 16A shows a state in which no sheet bundle is loaded on the sheet placing section 40.

When a first sheet bundle T1 is placed on the base plate 915, the detection lever 980 of the sheet sensor is sunk, and the transfer from the non-loading state to the loading state is detected. This information is transmitted to the image forming apparatus main body, and the image forming apparatus main body starts to count the loading number of sheet bundles.

Figure 16B:
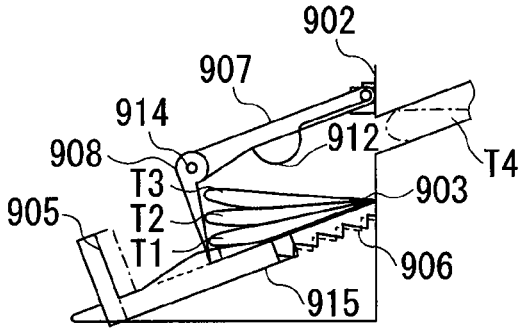

When next sheet bundles T2 and T3 are ejected from the image forming apparatus main body, as shown in FIG. 16B, the leading edge sides of the sheet bundles overlap on the base plate 915 and are loaded. At this time, the front end of the fore arm 908 is engaged with the wall of the recess of the base plate 915, and the sheet bundles T1, T2 and T3 are received by the fore arm 908.

Figure 16C:
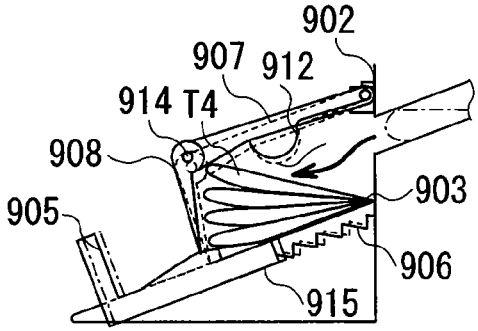

Further, when a next sheet bundle T4 is loaded, an upper part of the sheet bundle T4 contacts with the upper arm 907, and pushes up the upper arm 907 (FIG. 16C).

Figure 17A:
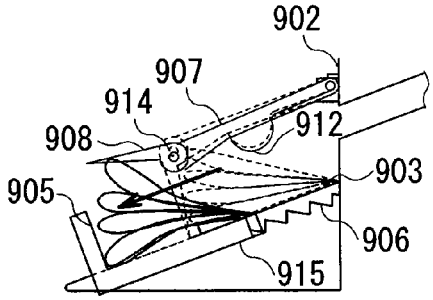

By this pushing-up, the fore arm 908 is also moved upward, and the engagement of the front end of the fore arm 908 is released. The fore arm 908 is urged in an outside rotation direction with respect to the shaft 914, and when the engagement of the front end of the fore arm 908 is released, as shown in FIG. 17A, the fore arm is released forward. Then, the sheet bundles T1 to T4 supported by the fore arm 908 are moved downward by their own weights along the inclination of the base plate 915, and are supported by the guard 905 this time.

Figure 17B:
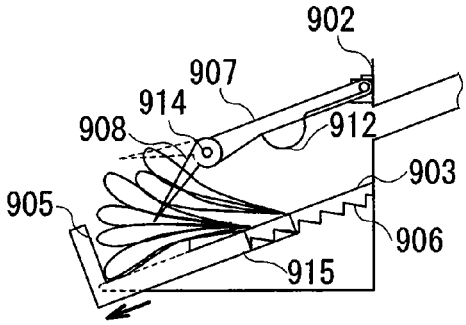
Figure 17C:
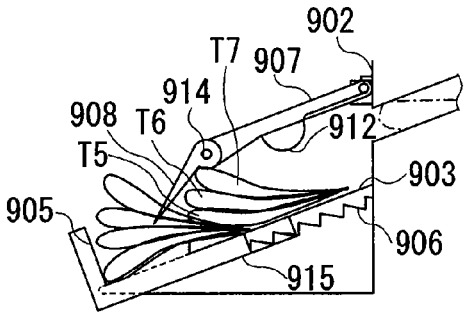

The guard 905 receiving the weights of the sheet bundles T1 to T4 moves downward against the urging force of the spring 906 (FIG. 17B). That is, the sheet bundles T1 to T4 move forward as one group. Thereafter, further ejected sheet bundles T5 to T7 are loaded at a position slightly shifted backward from the group of the sheet bundles T1 to T4 (FIG. 17C).

In the "standard mode", the loading number of sheet bundles is limited, and when the count of the loading number reaches a specified limit number, for example, 50, the image forming apparatus main body stops printing of sheets, and the sheet finisher 20 stops formation of sheet bundles.

On the other hand, the "unlimited mode" is the loading mode in which the loading number of sheet bundles is not limited, and even if the count of the loading number exceeds the limit number, the image forming apparatus main body continues to print sheets, and the sheet finisher 20 continues to form sheet bundles.

Figure 18:
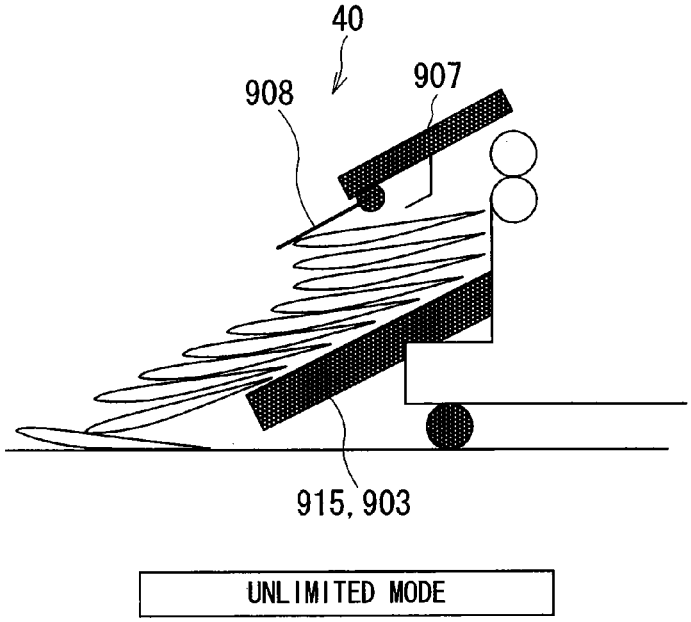
FIG. 18 is a view for explaining a sheet bundle loading state to the sheet placing section in an unlimited mode.

FIG. 18 is a view schematically showing a loading state in the "unlimited mode". In the "unlimited mode", since sheet bundles are successively ejected without limitation, the user previously removes the guard 905 of the base plate 915 before the operation in the "unlimited mode" is started. As shown in FIG. 18, when the number of sheet bundles increases, they slide down the base plate 915 and flow down to the floor. In the "unlimited mode", even if the number of sheet bundles (booklets) is large, the formation operation is not interrupted, and accordingly, a large number of booklets can be formed in a short time.

Figure 19:
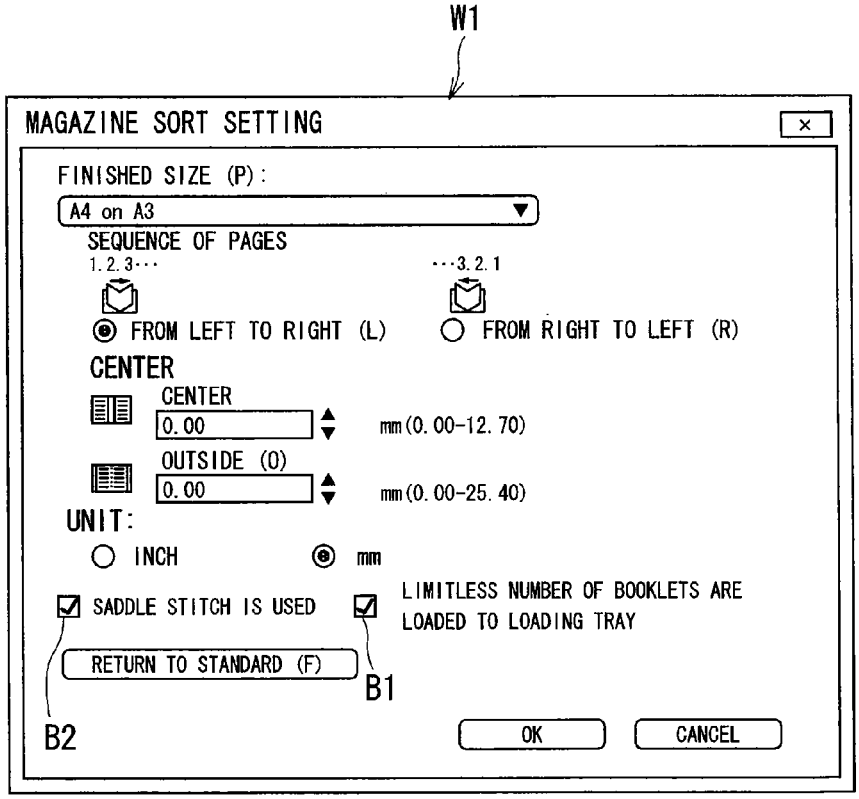
FIG. 19 is a view showing an example of a display screen for selecting and setting the standard mode or the unlimited mode.

FIG. 19 is a view showing an example of a window W1 for selecting and setting parameters relating to booklet formation. The window W1 is displayed on the operation section 9.

Boxes for setting the size of a booklet, the sequence of pages, and the amount of margin, and a check box B2 for selecting the presence or absence of saddle stitching (stapling) are provided on the window W1.

When a check box adjacent to a display of "LIMITLESS NUMBER OF BOOKLETS ARE LOADED TO LOADING TRAY" at the lower right of the window W1 is clicked, the "standard mode" is shifted to the "unlimited mode". When the same check box is clicked to erase the check mark "v", the "unlimited mode" is returned to the "standard mode".

Up to here, the two loading modes are explained. That is, what are the "standard mode" and the "unlimited mode", and how the two loading modes are selected are explained. The loading mode selected in the image forming apparatus main body is transmitted to the sheet finisher 20 at ACT 20 of FIG. 14.

Next, at ACT 21 of FIG. 14, "sheet information constituting the booklet" is acquired from the image forming apparatus main body. The "sheet information constituting the booklet" is information relating to the type of a sheet used for a cover sheet and the type of a sheet used for an inner sheet sandwiched between cover sheets. The type of a sheet includes, for example, "standard paper" (general copy paper) which is a sheet with a specified thickness or less, and "thick paper" thicker than the standard paper. The sheet information constituting the booklet is selected and set by, for example, a user.

FIG. 20 is a view showing a display example of a selection window W2 of the sheet information. This selection window W2 is also displayed on the operation section 9.

The example shown in FIG. 20 indicates that A3 size thick paper is contained in a "tray 1" 7A, A4 size standard paper is contained in a "tray 2" 7B, and A3 size standard paper is contained in a "tray 3" 7C. Besides, a hatched button indicates the type of a sheet selected by the user for the cover sheet and the inner sheet. In this example, the A3 size thick paper is selected for the cover sheet, and the A3 size standard paper is selected for the inner sheet.

The selected sheet information is transmitted from the image forming apparatus main body to the sheet finisher 20.

The sheet finisher 20 includes a control section having a CPU and the like, and the "loading mode" and the "sheet information" selected and set in the image forming apparatus main body are transmitted to the control section in the sheet finisher 20. The sheet finisher 20 includes also a storage section storing a table of the number of reinforcing times which associates the "loading mode" and the "sheet information" with the number of reinforcing times N.

At ACT 22 of FIG. 14, the control section refers to this table, and sets the number of reinforcing times N based on the acquired "loading mode" and "sheet information".

FIG. 21A is a view showing the concept of the table of the number of reinforcing times. In the sheet information, "all standard paper" indicates that all of the cover sheet and inner sheets are standard papers, "all thick paper" indicates that all of the cover sheet and inner sheets are thick papers, and "one thick paper (cover sheet)" indicates that only the cover sheet is the thick paper and the other inner sheets are standard papers. Although specific values of the numbers of reinforcing times N1 to N6 are not particularly limited, in general, they are set to satisfy a relation of N1<N2<N3 and N4<N5<N6, and are set so that as the number of thick papers becomes large, the number of reinforcing times becomes large (see FIG. 21B).

Besides, in general, setting is made to satisfy a relation of N1<N4, N2<N5 and N3<N6, and the number of reinforcing times in the "unlimited mode" is larger than the number of reinforcing times in the "standard mode" (see FIG. 21B). When the "unlimited mode" is selected, a large number of booklets may be formed, and to make the booklet as thin as possible satisfies the need of a user, from the viewpoint of handling the large number of booklets. Besides, when booklets having the same number of copies are formed, since the formation process is not interrupted in the "unlimited mode", it is conceivable that even if the formation time for one copy becomes slightly long, this is allowable.

The numbers of reinforcing times N1 to N6 are, for example, N1=1, N2=3, N3=5, N4=2, N5=5 and N6=8.

At ACT 23 of FIG. 14, reinforcing is performed in accordance with the set number of reinforcing times N. At ACT 23, in the first reinforcing, the process of ACT 1 to ACT 13 of FIG. 12 is performed, and in the second reinforcing or later, the process of ACT 5 to ACT 13 of FIG. 12 is performed.

When the number of reinforcing times reaches the set number of times N, the reinforcing on the sheet bundle is ended (ACT 24), and the sheet bundle is moved in the transport direction and is ejected to the sheet placing section 40 (ACT 25).

In the above, although the example is described in which the number of reinforcing times N is set based on both the "loading mode" and the "sheet information", the number of reinforcing times N may be set based on only the "sheet information", and vice versa.

As stated above, in the method of setting the number of reinforcing times according to the first embodiment, when the user sets the information of sheets constituting the booklet and the loading mode, the suitable number of reinforcing times is automatically selected and set without performing a specific operation for setting the number of reinforcing times, and the booklet having the excellent fold line can be formed.

(5) Setting of the Number of Reinforcing Times

Second Embodiment

In the first embodiment, the user sets the sheet information of the booklet from the operation section 9. On the other hand, in a method of setting the number of reinforcing times according to a second embodiment, the thickness of a sheet constituting the booklet is detected in the inside of the image forming apparatus main body, and the type of the sheet such as standard paper or thick paper is determined from the detected thickness of the sheet.

Figure 22:
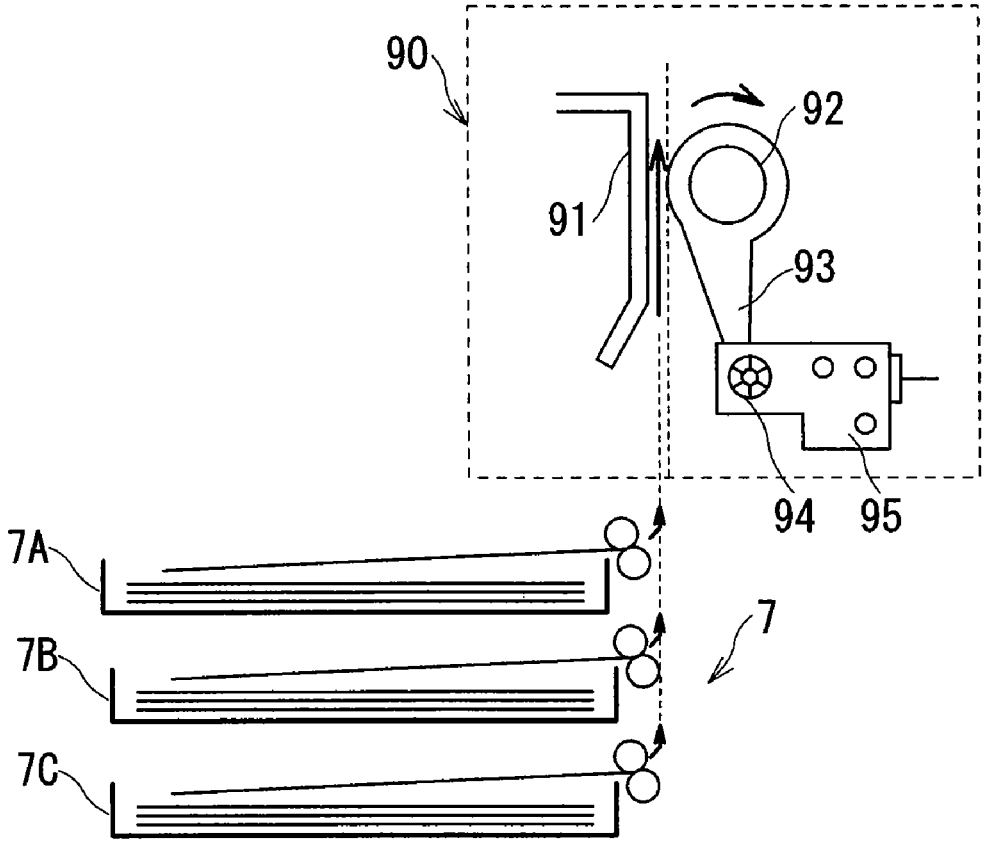
FIG. 22 is a view showing an example of arrangement of a paper thickness detection section.

As shown in FIG. 2 and FIG. 22, the image forming apparatus 10 includes a paper thickness detection section 90, and a sheet fed from the sheet containing section 7 passes through the paper thickness detection section 90.

Figure 23A:
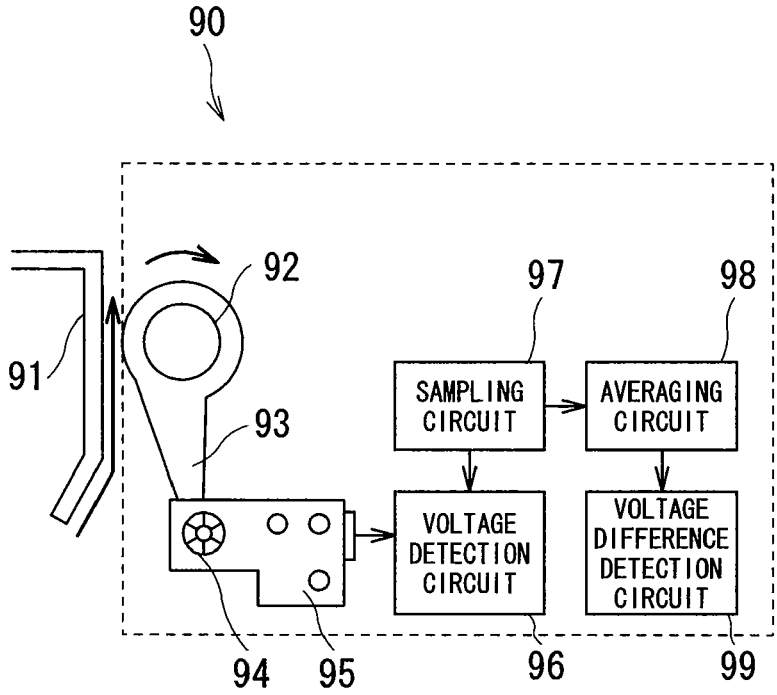
FIG. 23A is a view showing a structural example of the paper thickness detection section.

FIG. 23A is a view showing a structural example of the paper thickness detection section 90. The paper thickness detection section 90 includes a guide plate 91, a bearing 92, a magnetic sensor 95, a voltage detection circuit 96, a sampling circuit 97, an averaging circuit 98, a voltage difference detection circuit 99 and the like. The bearing 92 is rotatably supported by a shaft 94 through an arm 93, and is urged in a direction of the guide plate 91.

Figure 23B:
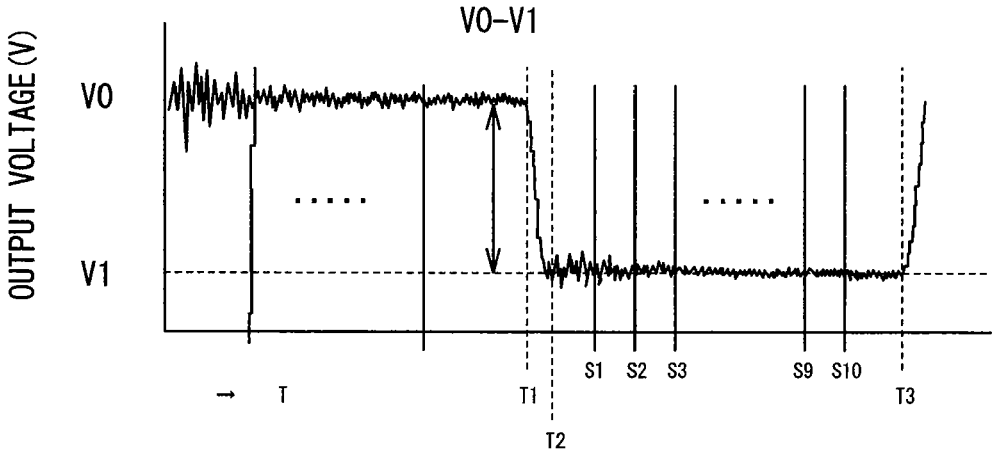
FIG. 23B is a view showing an example of a signal waveform processed by the paper thickness detection section.

When a sheet passes through between the guide plate 91 and the bearing 92, the arm 93 rotates around the shaft 94 in the clockwise direction in FIG. 23A. The rotation amount depends on the thickness of the sheet, and as the sheet becomes thicker, the rotation amount becomes larger. A magnet is fixed to a root of the arm 93, and the rotation amount of the arm is converted into a voltage by the magnetic sensor 95. The voltage outputted from the magnetic sensor 95 is amplified by the voltage detection circuit 96, and is sampled by the sampling circuit 97, and then is averaged by the averaging circuit 98. A voltage V0 shown in FIG. 23B is an average voltage when a sheet does not pass, and a voltage V1 is an average voltage when a sheet passes. The voltage difference detection circuit 99 detects a voltage difference (V0-V1) between the average voltage V0 when the sheet does not pass and the average voltage V1 when the sheet passes. Since the voltage difference varies according to the rotation amount of the arm 93, that is, the thickness of the sheet, the thickness of the sheet can be detected from the voltage difference (V0-V1).

In the method of setting the number of reinforcing times according to the second embodiment, the standard paper and the thick paper are distinguished based on the thickness of the sheet detected as stated above, and the sheet information used at ACT 21 of FIG. 14 is acquired.

In the method of setting the number of reinforcing times according to the second embodiment, since the thickness of the sheet is automatically detected, the operation of selecting the sheet constituting the booklet is unnecessary or is reduced. For example, a cover sheet and an inner sheet can be distinguished based on the sequence of sheets transported to the sheet finisher 20, and the type (thick paper or standard paper) of the cover sheet and the inner sheet can be distinguished based on the thickness information detected by the paper thickness detection section 90.

(6) Reciprocating Range of Reinforce Roller

FIG. 24 is a view showing a reciprocating range of a reinforce roller when reinforcing is performed plural times on one sheet bundle.

Before the reinforcing is started, the reinforce roller (roller unit 60) is located-at a home position (HP) on the left side of FIG. 24.

As stated above, when the reinforcing is started, the roller unit 60 is separated from the home position, and starts to move toward the opposite side of the home position. Meanwhile, the upper roller 51*a* and the lower roller 51*b* of the reinforce roller, which are separated from each other at the home position, approach each other, and are brought into a state in which they are pressed to each other at a position before the edge of the sheet bundle. When the reinforce roller comes to the position of the edge of the sheet bundle, the upper roller 51*a* climbs over the edge of the sheet bundle, and the sheet bundle is nipped between the lower roller 51*b* and the upper roller 51*a*. Then, the two rollers apply pressure to the sheet bundle and move in the fold line direction to reinforce the fold line.

When the reinforce roller reaches the edge of the sheet bundle at the opposite side to the home position, the reinforce roller changes the direction and starts to move to the home position. After passing through the home position side edge of the sheet bundle, the reinforce roller returns to the home position.

The movement of the reinforce roller when reinforcing is performed once is as described above. Even if the number of reinforcing times is two or more, in a standard process performed hitherto, as shown in FIG. 24A, the same movement is repeated (this is called standard reciprocating-type reinforcing).

Figures 24A, 24B:
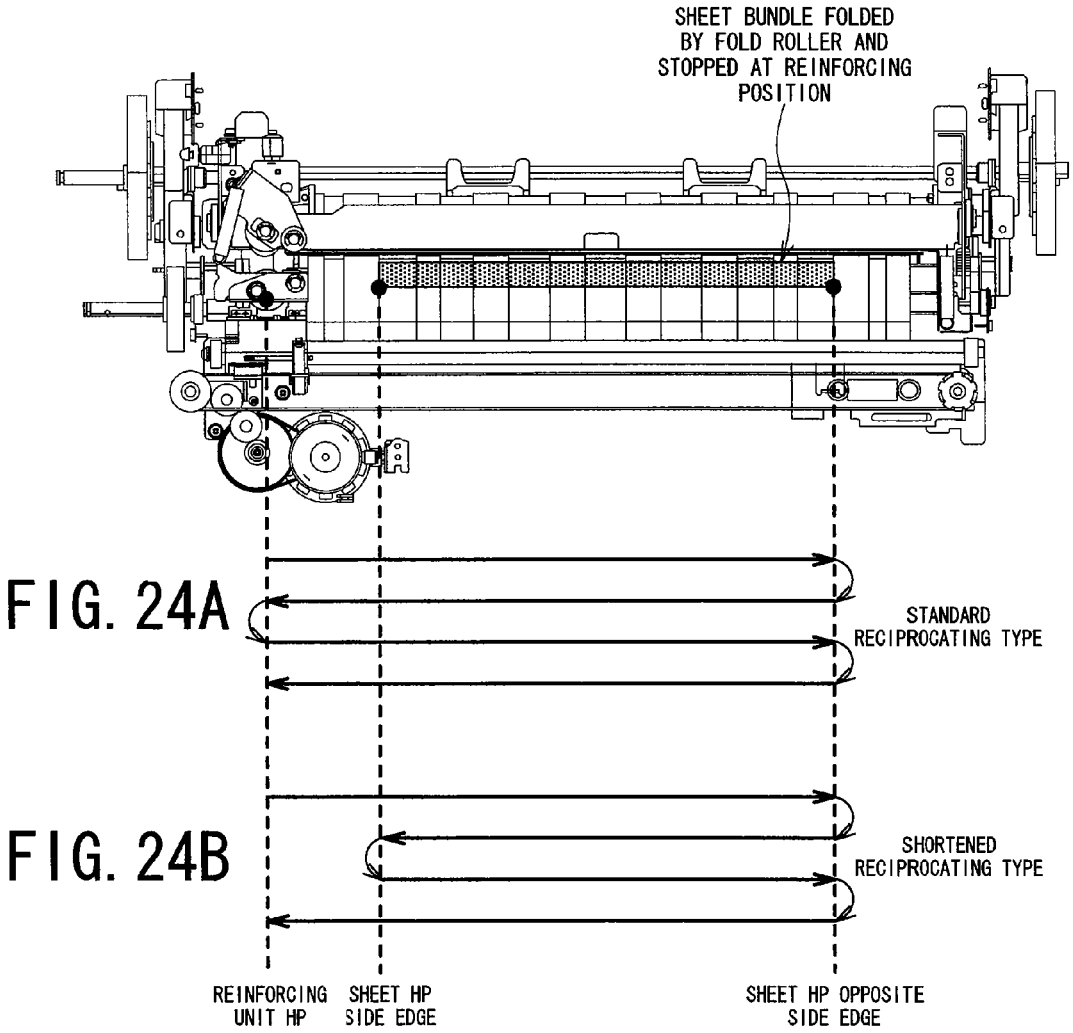
FIG. 24 is a view comparatively exemplifying reciprocating ranges of a standard reciprocating type and a shortened reciprocating type.

On the other hand, in another embodiment of the image forming apparatus 10, as shown in FIG. 24B, shortened reciprocating-type reinforcing is performed.

In the shortened reciprocating-type reinforcing, among plural reciprocating movements, the roller is returned to the home position only at the final outgoing path movement, and in the other intermediate reciprocating movements, the reinforce roller reciprocates between both the edges of the sheet bundle.

According to the shortened reciprocating-type reinforcing, at the intermediate reciprocating movement, the movement between the home position side edge of the sheet bundle and the home position becomes unnecessary. As a result, the time required for the reinforcing is shortened, and the booklet formation time is also shortened.

Besides, when the reinforce roller moves in a section between the edge (home position side) of the sheet bundle and the home position, the upper roller 51*a* and the lower roller 51*b* approach each other and are separated from each other against the elastic force of the spring. Thus, power consumption becomes larger than the power consumption when they move in the other area. In the shortened reciprocating-type reinforcing, since the movement in the section where the power consumption is large is remarkably reduced, power can be saved in total.

Further, since high elastic force is exerted between the upper roller 51*a* and the lower roller 51*b*, when both contact with each other, a certain level of collision sound is generated, and becomes an unpleasant noise according to circumstances. In the shortened reciprocating-type reinforcing, since the upper roller 51*a* and the lower roller 51*b* directly intensely contact with each other only on the first outgoing path, the frequency of generation of the collision sound can be greatly reduced.

Furthermore, since the upper roller 51*a* climbs over the edge of the sheet bundle only on the first outgoing path, a possibility that a scratch or a wrinkle occurs in the edge of the sheet bundle is greatly reduced.

Figure 25A:
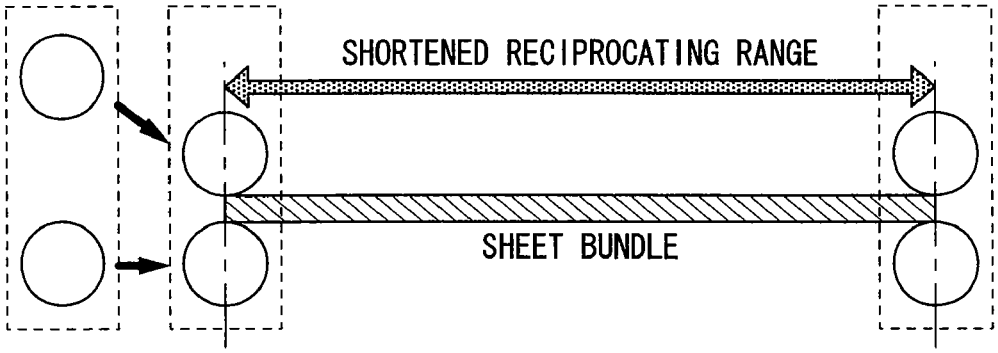
FIGS. 25A and 25B are views exemplifying reciprocating ranges in the shortened reciprocating type.
Figure 25B:
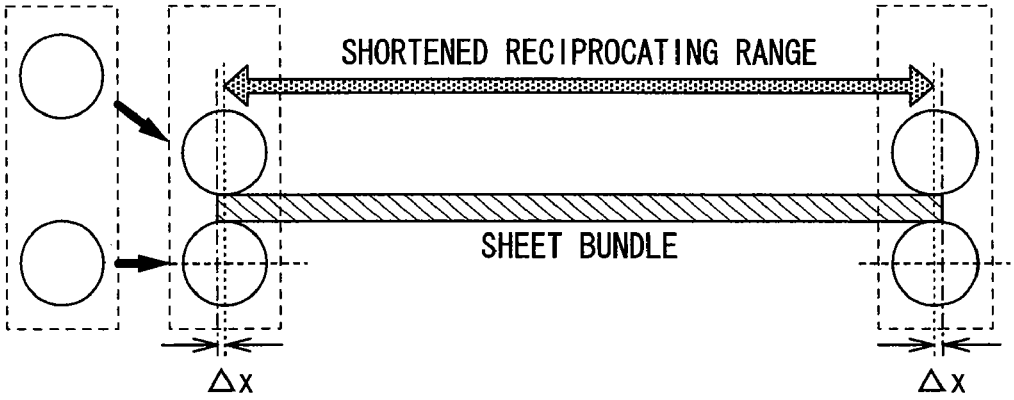

FIGS. 25A and 25B are views showing the reciprocating range of the reinforce roller in the shortened reciprocating type. As shown in these views, it is desirable that the reciprocating movement is performed within the range where the rotation center of the reinforce roller does not exceed both the edges of the sheet bundle. When the rotation center of the reinforce roller exceeds both or one of the edges of the sheet bundle, there is a possibility that the upper roller 51*a* is pulled downward by the elastic force of the spring, and slides down the edge of the sheet bundle, and the upper roller 51*a* and the lower roller 51*b* directly contact with each other. When both the rollers directly contact with each other, the roller must climb over the edge of the sheet bundle again when the movement in the opposite direction starts, power consumption increases, and there is also a fear that a scratch or a wrinkle occurs in the edge of the sheet bundle.

Then, as shown in FIG. 25B, it is desirable that the movement direction is changed at a position where a certain degree of margin ($\Delta x$) is provided from both the edges of the sheet bundle. When the margin is provided, it is possible to certainly prevent the phenomenon that the upper roller 51*a* slides down at both the edges of the sheet bundle.

The invention is not limited to the respective embodiments, but can be embodied while modifying the components within the scope not departing from the gist thereof at the practical phase. Besides, various embodiments of the invention can be formed by suitable combinations of plural components disclosed in the respective embodiments. For example, some components may be deleted from all components disclosed in the embodiment. Further, components in different embodiments may be suitably combined.

What is claimed is:

1. A sheet folding apparatus comprising:

a fold unit configured to fold a center of a sheet bundle to form a fold line, wherein the sheet bundle on which the fold line is formed includes a cover sheet and an inner sheet sandwiched between the cover sheet;

a reinforce roller configured to reciprocate along a direction of the fold line while nipping and pressing the fold line and reinforce the fold line of the sheet bundle; and a control section configured to:

set the number of times of reciprocating movement of the reinforce roller to a first number of times when each of the cover sheet and the inner sheet is a standard paper with a specified thickness or less, and set the number of times of reciprocating movement of the reinforce roller to a second number of times larger than the first number of times when the cover sheet is a thick paper thicker than the standard paper and the inner sheet is the standard paper.

2. The apparatus of claim 1, wherein the control section sets the number of times of reciprocating movement to a third number of times larger than the second number of times when each of the cover sheet and the inner sheet is the thick paper.

3. The apparatus of claim 1, wherein when a first paper feed tray in which the standard paper is contained and a second paper feed tray in which the thick paper is contained are selectable, the control section sets the number of times of reciprocating movement to the first number of times when each of the cover sheet and the inner sheet is fed from the first paper feed tray, and the control section sets the number of times of reciprocating movement to the second number of times when the cover sheet is fed from the second paper feed tray and the inner sheet is fed from the first paper feed tray.

4. The apparatus of claim 1, wherein the control section determines thicknesses of the cover sheet and the inner sheet based on thickness information outputted from a thickness sensor to detect a thickness of a sheet, the control section sets the number of times of reciprocating movement to the first number of times when each of the cover sheet and the inner sheet is the standard paper, and the control section sets the number of times of reciprocating movement to the second number of times when the cover sheet is the thick paper and the inner sheet is the standard papers.

5. The apparatus of claim 1, further comprising a loading tray on which a plurality of the sheet bundles with reinforced fold lines are loaded, wherein when a standard mode in which the loading number of the sheet bundles loaded on the loading tray is limited and an unlimited mode in which the loading number is not limited are selectable, when the standard mode is selected, the control section sets the number of times of reciprocating movement to the first number of times when each of the cover sheet and the inner sheet is the standard paper, the control section sets the number of times of reciprocating movement to the second number of times when the cover sheet is the thick paper and the inner sheet is the standard paper, when the unlimited mode is selected, the control section sets the number of times of reciprocating movement to a fourth number of times larger than the first number of times when each of the cover sheet and the inner sheet is the standard paper, and the control section sets the number of times of reciprocating movement to a fifth number of times larger than the second number of times when the cover sheet is the thick paper and the inner sheet is the standard paper.

6. An image forming apparatus comprising:

a read section configured to read an original document to generate image data;

an image forming section configured to print the image data to a sheet;

a fold unit configured to bundle printed sheets to form a sheet bundle and to fold a center of the sheet bundle to form a fold line, wherein the sheet bundle on which the fold line is formed includes a cover sheet and an inner sheet sandwiched between the cover sheet;

a reinforce roller configured to reciprocate along a direction of the fold line while nipping and pressing the fold line and reinforce the fold line of the sheet bundle; and a control section configured to:

set the number of times of reciprocating movement of the reinforce roller to a first number of times when each of the cover sheet and the inner sheet is a standard paper with a specified thickness or less, and set the number of times of reciprocating movement of the reinforce roller to a second number of times larger than the first number of times when the cover sheet is a thick paper thicker than the standard paper and the inner sheet is the standard paper.

7. The apparatus of claim 6, wherein the control section sets the number of times of reciprocating movement to a third number of times larger than the second number of times when each of the cover sheet and the inner sheet is the thick paper.

8. The apparatus of claim 6, further comprising a first paper feed tray in which the standard paper is contained and a second paper feed tray in which the thick paper is contained, wherein the control section sets the number of times of reciprocating movement to the first number of times when each of the cover sheet and the inner sheet is fed from the first paper feed tray, and the control section sets the number of times of reciprocating movement to the second number of times when the cover sheet is fed from the second paper feed tray and the inner sheet is fed from the first paper feed tray.

9. The apparatus of claim 6, further comprising a thickness sensor to detect a thickness of a sheet, wherein the control section determines thicknesses of the cover sheet and the inner sheet based on thickness information outputted from the thickness sensor, the control section sets the number of times of reciprocating movement to the first number of times when each of the cover sheet and the inner sheet is the standard paper, and the control section sets the number of times of reciprocating movement to the second number of times when the cover sheet is the thick paper and the inner sheet is the standard paper.

10. The apparatus of claim 6, further comprising a loading tray on which a plurality of the sheet bundles with reinforced fold lines are loaded, wherein when a standard mode in which the loading number of the sheet bundles loaded on the loading tray is limited and an unlimited mode in which the loading number is not limited are selectable, when the standard mode is selected, the control section sets the number of times of reciprocating movement to the first number of times when each of the cover sheet and the inner sheet is the standard paper, the control section sets the number of times of reciprocating movement to the second number of times when the cover sheet is the thick paper and the inner sheet is the standard paper, when the unlimited mode is selected, the control section sets the number of times of reciprocating movement to a fourth number of times larger than the first number of times when each of the cover sheet and the inner sheet is the standard paper, and the control section sets the number of times of reciprocating movement to a fifth number of times larger than the second number of times when the cover sheet is the thick paper and the inner sheet is the standard paper.

11. A sheet folding method comprising:

forming a fold line by folding a center of a sheet bundle, wherein the sheet bundle on which the fold line is formed includes a cover sheet and an inner sheet sandwiched between the cover sheet;

reinforcing the fold line of the sheet bundle by reciprocating movement along a direction of the fold line while the fold line is nipped and pressed;

setting the number of times of the reciprocating movement to a first number of times when each of the cover sheet and the inner sheet is a standard paper with a specified thickness or less, and setting the number of times of the reciprocating movement to a second number of times larger than the first number of times when the cover sheet is a thick paper thicker than the standard paper and the inner sheet is the standard paper.

12. The method of claim 11, wherein in the setting, the number of times of the reciprocating movement is set to a third number of times larger than the second number of times when each of the cover sheet and the inner sheet is the thick paper.

13. The method of claim 11, wherein in the setting, when a first paper feed tray in which the standard paper is contained and a second paper feed tray in which the thick paper is contained are selectable, the number of times of the reciprocating movement is set to the first number of times when each of the cover sheet and the inner sheet is fed from the first paper feed tray, and the number of times of the reciprocating movement is set to the second number of times when the cover sheet is fed from the second paper feed tray and the inner sheet is fed from the first paper feed tray.

14. The method of claim 11, wherein in the setting, thicknesses of each of the cover sheet and the inner sheet is determined based on thickness information outputted from a thickness sensor to detect a thickness of a sheet, the number of times of the reciprocating movement is set to the first number of times when each of the cover sheet and the inner sheet is the standard paper, and the number of times of the reciprocating movement is set to the second number of times when the cover sheet is the thick papers and the inner sheet is the standard paper.

15. The method of claim 11, wherein in the setting, when a standard mode in which the loading number of the sheet bundles loaded on a loading tray is limited and an unlimited mode in which the loading number is not limited are selectable, when the standard mode is selected, the number of times of the reciprocating movement is set to the first number of times when each of the cover sheet and the inner sheet is the standard paper, the number of times of the reciprocating movement is set to the second number of times when the cover sheet is the thick paper and the inner sheet is the standard paper, when the unlimited mode is selected, the number of times of the reciprocating movement is set to a fourth number of times larger than the first number of times when each of the cover sheet and the inner sheet is the standard paper, and the number of times of the reciprocating movement is set to a fifth number of times larger than the second number of times when the cover sheet is the thick paper and the inner sheet is the standard paper.

* * * * *